US006808021B2

(12) United States Patent
Zimmerman et al.

(10) Patent No.: US 6,808,021 B2
(45) Date of Patent: Oct. 26, 2004

(54) SUBSEA INTERVENTION SYSTEM

(75) Inventors: Thomas H. Zimmerman, Houston, TX (US); John A. Kerr, Sugar Land, TX (US); Alan R. Christie, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/921,026

(22) Filed: Aug. 2, 2001

(65) Prior Publication Data

US 2002/0040783 A1 Apr. 11, 2002

Related U.S. Application Data

(60) Provisional application No. 60/225,439, filed on Aug. 14, 2000, provisional application No. 60/225,440, filed on Aug. 14, 2000, and provisional application No. 60/225,230, filed on Aug. 14, 2000.

(51) Int. Cl.[7] ..... F21B 41/01; B63G 8/00

(52) U.S. Cl. ..... 166/381; 166/340; 166/341; 405/188; 405/191; 114/313; 114/322

(58) Field of Search ..... 166/338, 337, 166/346, 341, 365, 381; 405/216, 188, 189, 190, 191; 114/337, 338, 312, 322, 313

(56) References Cited

U.S. PATENT DOCUMENTS 3,099,316 A * 7/1963 Johnson ..... 137/236.1
3,633,667 A 12/1969 Falkner, Jr.
3,520,358 A * 7/1970 Brooks et al. ..... 166/356
3,621,911 A * 11/1971 Baker et al. ..... 166/336
3,643,736 A * 2/1972 Talley, Jr. ..... 166/245
RE27,745 E * 8/1973 Brooks et al. ..... 166/336
3,766,742 A * 10/1973 Smith et al. ..... 114/337
3,777,812 A * 12/1973 Burkhardt et al. ..... 166/338
4,194,857 A 3/1980 Chateau et al.
4,618,285 A * 10/1986 Ahlstone ..... 405/191
4,674,915 A * 6/1987 Shatto, Jr. ..... 114/250
4,848,474 A * 7/1989 Parizot et al. ..... 166/339
5,046,895 A * 9/1991 Baugh ..... 405/188
5,273,376 A * 12/1993 Ritter, Jr. ..... 405/169
6,167,831 B1 * 1/2001 Watt et al. ..... 114/245
6,223,675 B1 * 5/2001 Watt et al. ..... 114/312
6,260,504 B1 * 7/2001 Moles et al. ..... 114/312
6,422,315 B1 * 7/2002 Dean ..... 166/339

FOREIGN PATENT DOCUMENTS

GB 2210838 A * 6/1989 ..... B63B/21/00

* cited by examiner

*Primary Examiner*—David Bagnell
*Assistant Examiner*—Jennifer H Gay
(74) *Attorney, Agent, or Firm*—Trop, Pruner & Hu, P.C.; Jeffrey E. Griffin; Brigitte Echols

(57) ABSTRACT

A system that is usable with subsea wells that extend beneath a sea floor includes a station that is located on the sea floor and an underwater vehicle. The underwater vehicle is housed in the station and is adapted to service at least one of the subsea wells.

44 Claims, 18 Drawing Sheets

SUBSEA INTERVENTION SYSTEM

CROSS-REFERENCE OF RELATED APPLICATIONS

This application claims the benefit under 35 U.S.C. § 119 to U.S. Provisional Patent Application Ser. No. 60/225,439, entitled "WELL HAVING A SELF-CONTAINED WELL INTERVENTION SYSTEM," U.S. Provisional Patent Application Ser. No. 60/225,440, entitled "SUBSEA INTERVENTION SYSTEM," and U.S. Provisional Application Ser. No. 60/225,230, entitled "SUBSEA INTERVENTION," all of which were filed on Aug. 14, 2000.

BACKGROUND

The invention generally relates to a subsea intervention system.

Subsea wells are typically completed in generally the same manner as conventional land wells. Therefore, subsea wells are subject to the same service requirements as land wells. Further, services performed by intervention can often increase the production from the well. However, intervention into a subsea well to perform the required service is extremely costly. Typically, to complete such an intervention, the operator must deploy a rig, such as a semi-submersible rig, using tensioned risers. Thus, to avoid the costs of such intervention, some form of "light" intervention (one in which a rig is not required) is desirable.

Often, an operator will observe a drop in production or some other problem, but will not know the cause. To determine the cause, the operator must perform an intervention. In some cases the problem may be remedied while in others it may not. Also, the degree of the problem may only be determinable by intervention. Therefore, one level of light intervention is to ascertain the cause of the problem to determine whether an intervention is warranted and economical.

A higher level of light intervention is to perform some intervention service without the use of a rig. Shutting in a zone and pumping a well treatment into a well are two examples of many possible intervention services that may be performed via light intervention.

Although some developments in the field, such as intelligent completions, may facilitate the determination of whether to perform a fig intervention, they do not offer a complete range of desired light intervention solutions. In addition, not all wells are equipped with the technology. Similarly, previous efforts to provide light intervention do not offer the economical range of services sought.

A conventional subsea intervention may involve use a surface vessel to supply equipment for the intervention and serve as a platform for the intervention. The vessel typically has a global positioning satellite system (GPS) and side thrusters that allow the vessel to precisely position itself over the subsea well to be serviced. While the vessel holds its position, a remotely operated vehicle (ROV) may then be lowered from the vessel to find a wellhead of the subsea well and initiate the intervention. The ROV typically is used in depths where divers cannot be used. The ROV has a tethered cable connection to the vessel, a connection that communicates power to the ROV; communicates video signals from the ROV to the vessel; and communicates signals from the vessel to the ROV to control the ROV.

A typical ROV intervention may include using the ROV to find and attach guide wires to the wellhead. These guidewires extend to the surface vessel so that the surface vessel may then deploy a downhole tool or equipment for the well. In this manner, the deployed tool or equipment follows the guide wires from the vessel down to the subsea wellhead. The ROV typically provides images of the intervention and assists in attaching equipment to the wellhead so that tools may be lowered downhole into the well.

The surface vessel for performing the above-described intervention may be quite expensive due to the positioning capability of the vessel and the weight and size of the equipment that must be carried on the vessel. Thus, there is a continuing need for an arrangement that addresses one or more of the problems that are stated above.

SUMMARY

In an embodiment of the invention, a system that is usable with subsea wells that extend beneath a sea floor includes a station that is located on the sea floor and an underwater vehicle. The vehicle is housed in the station and is adapted to service at least one of the subsea wells.

Advantages and other features of the invention will become apparent from the following description, drawing and claims.

DETAILED DESCRIPTION

Figure 1:
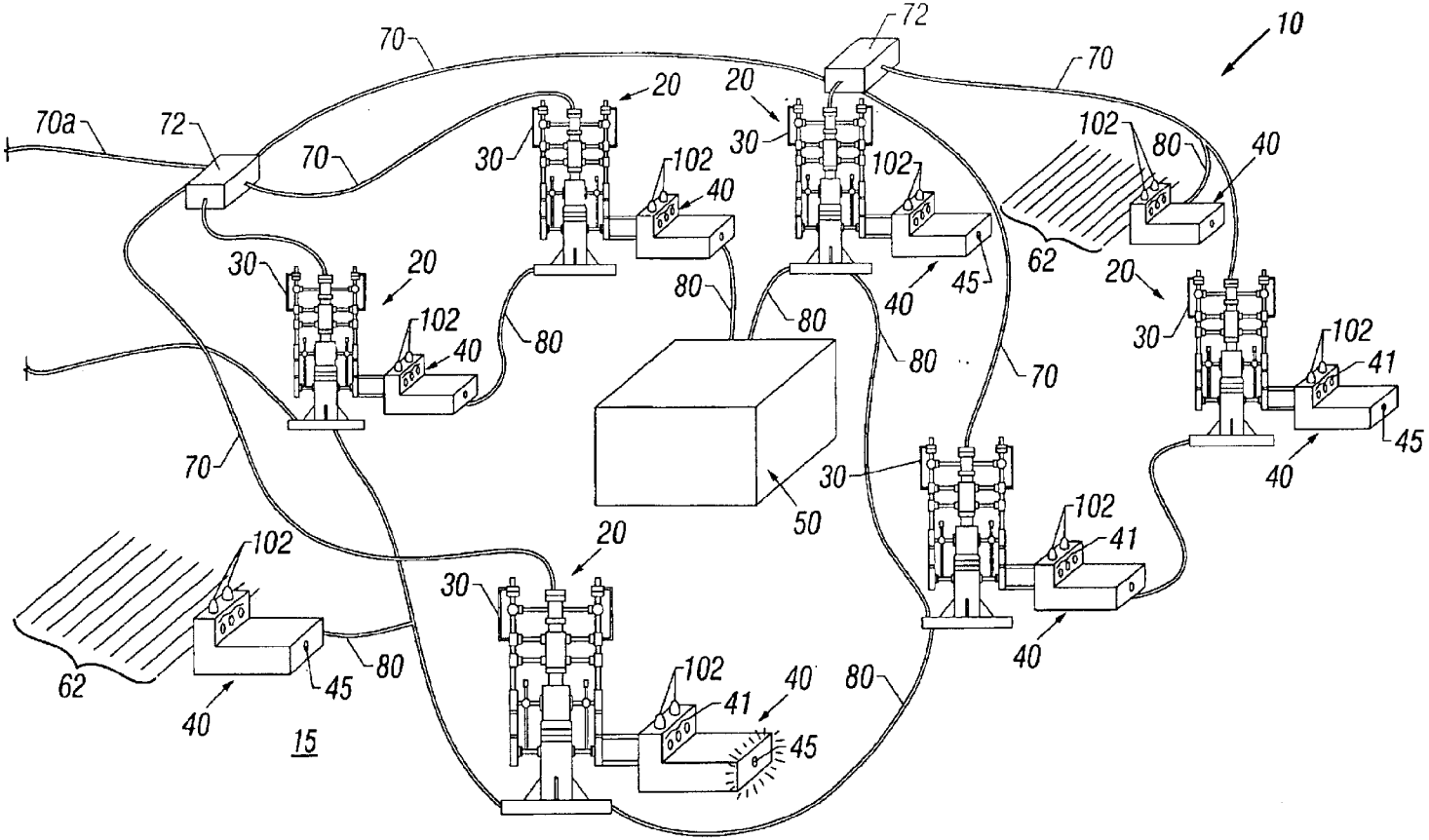
FIGS. 1, 7, 7A and 8 are schematic diagrams of subsea production systems according to different embodiments of the invention.

Referring to FIG. 1, an embodiment of a subsea production system 10 according to an embodiment of the invention includes a field of subsea wellhead assemblies 20 that are located on the sea floor 15. In this manner, each subsea wellhead assembly 20 is part of a separate subsea well that may require servicing over its lifetime. Unlike a conventional intervention in which a surface vessel deploys a tethered remotely operated vehicle (ROV), autonomous underwater vehicle (AUV) and/or other equipment to perform the intervention, in the system 10, the intervention may be performed using equipment that is stationed on the sea floor 15.

More specifically, the system 10 includes a station 50 that is located on the sea floor 15 and houses a marine underwater vehicle (an ROV or AUV, as examples). The station 50 provides power to and communicates with an associated underwater vehicle (not shown in FIG. 1) that resides at the station 50 until an intervention is needed at one of the wells in the field. The station 50 also, in some embodiments of the invention, contains tools and other equipment that may be needed for an intervention. Therefore, when such an intervention is needed, the underwater vehicle gathers the appropriate tools and equipment from the station 50 for the intervention; deploys from the station 50 to the wellhead assembly 20 that is associated with the well to be serviced; performs the intervention; and subsequently returns to the station 50. As described below, in some embodiments of the invention, the underwater vehicle is self-guided and self-powered when traveling between the station 50 and the wellhead assembly 20. Therefore, the underwater vehicle does not have a tethered cable or wire connection to the station 50 or any other point when traveling along the sea floor 15. In other embodiments of the invention, the underwater vehicle may have a tethered connection to the station 50.

In some embodiments of the invention, the underwater vehicle receives power to recharge and maintain the charge on its battery when the underwater vehicle is docked to the station 50. Furthermore, when docked to the station 50, the underwater vehicle also communicates to an operator at the surface of the sea via a tethered cable between station 50 and equipment at the surface. The underwater vehicle may also dock to a particular wellhead assembly 20 to allow the underwater vehicle to communicate with the surface and receive power from the surface, as each wellhead assembly 20 is also connected to receive power from and communicate with equipment at the surface.

By communicating with the wellhead assemblies 20, a surface computer may determine that a particular well needs servicing. Upon this occurrence, an operator at the surface (or alternatively, the computer itself) may communicate with the underwater vehicle when the vehicle is docked to the station 50 to inform the underwater vehicle as to the identity of the particular well (and thus, identify the well head assembly 20) that needs intervention as well as the type of intervention that is required. In response to these instructions, the underwater vehicle may then obtain the appropriate tools and/or equipment from the station 50 and proceed in a self-guided, self-powered trip to the identified well head assembly 20 to perform the intervention. Alternatively, this technique may be less automated. In this manner, the operator at the surface may send control signals to the underwater vehicle to cause the underwater vehicle to load the appropriate tools and equipment and then send a control signal to cause the underwater vehicle to leave the station 50.

In some embodiments of the invention, the underwater vehicle detects light that is emitted from a light source 45 at the wellhead assembly 20 associated with the intervention, guides itself to the light source 45 and then docks to the wellhead assembly 20 before performing the intervention. Thus, before the underwater vehicle travels to the wellhead assembly 20, an operator at the surface turns on the light source 45 at the wellhead assembly 20. As an example, the light source 45 may be a blue-green laser. Alternatively, the light source 45 may be replaced by an acoustic emitter that transits a sound wave for purposes of guiding the underwater vehicle (that has a sonar transducer) to the associated wellhead assembly 20. In another embodiment, electromagnetic communications through the sea water may be used. Other navigation techniques may be used.

In some embodiments of the invention, each wellhead assembly 20 includes a wellhead tree 30 and a docking station 40 for the underwater vehicle. The docking station 40 includes connectors (inductive coupling connectors, for example) 41 to provide power to the underwater vehicle and permit the underwater vehicle to communicate with the surface. While docked to the station 40, the underwater vehicle may use the power that is furnished by the docking station 40 to recharge its batteries and power operations of the underwater vehicle. As depicted in FIG. 1, the docking station 40 may include the light source 45 to guide the underwater vehicle to the docking station 40 as well as other lights to aid in positioning the underwater vehicle for docking, as described below.

The wellhead assemblies 20 may communicate with a surface platform using several different techniques such as laser communication (via a blue-green laser), acoustics, and electromagnetic communication through sea water or communication through risers and pipelines. Regarding communication through risers, a section of coaxial tubing behaves in a similar way to an imperfect coaxial cable. By creating a current path inside (or outside) the riser a leakage current is induced on the outside (or inside) of the riser and using this current communications can be established. The results from tests suggest that data rates in the order of 40 kb/sec can be achieved using a 100 kHz carrier in riser communications, and the power requirements for such an arrangement are in the order of 1 watt.

Besides being attached to each well tree 30 to dock the underwater vehicle near a well to be serviced, the docking station 40 may used at other places, such as in the station 50 (as described below) and near subsea receiving regions 62. The regions 62 are designated areas for receiving tools and other equipment that are dropped from the surface.

In some embodiments of the invention, the wellhead assemblies 20 of a particular field may be connected by production tubing 70 to production equipment on land or on a floating platform, as examples. As an example, this production tubing 70 may be interconnected via subsea pumping stations 72 so that a particular production tubing **70*a* carries the well fluids produced at several wells to the land or to a floating platform (as examples). In some embodiments of the invention, each wellhead assembly 20 has an associated cable 80 for receiving power from the surface and for communicating with the surface. These cables may or may not be coupled together (as depicted in FIG. 1), depending on the particular embodiment of the invention. The docking stations 40 for the receiving regions 62 also are electrically coupled to the surface for communication and power via cables 80**.

Figure 2:
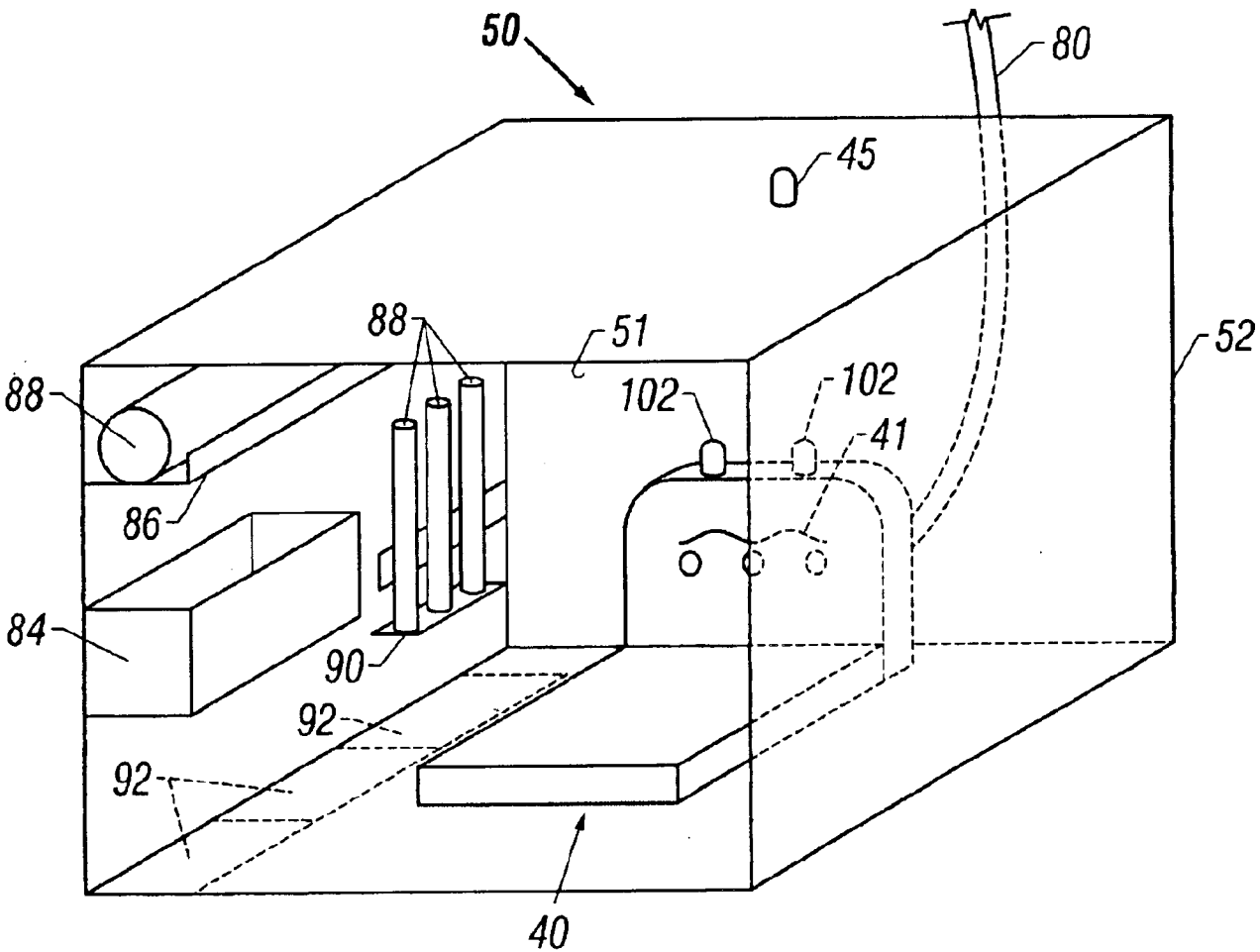
FIG. 2 is perspective view of a station for an underwater vehicle of the system of FIG. 1 according to an embodiment of the invention.

FIG. 2 depicts an exemplary embodiment of the station 50. As shown, in some embodiments of the invention, the station 50 may be at least a partially enclosed structure (a stainless steel box-like structure or a plastic dome-like structure (not shown in FIG. 2), as examples) that has an opening 51 to receive the underwater vehicle when docked. In some embodiments of the invention, the opening 51 may be closed by a door (not shown) to form a sealed enclosure. The station 50 includes a docking station 40 that includes the connectors 41 for establishing power and communication connections for the underwater vehicle when docked and is attached via a cable 80 to the surface. For the station 50, the light source 45 is located on the top of the station 50 instead of on the docking station 40.

Besides housing the underwater vehicle when not in use, the station 50 may also serve as a storage room for the various tools and equipment that may be needed by the underwater vehicle to perform the downhole interventions. For example, the station 50 may include one or more storage bins 84, one or more vertical racks 90 and one or more horizontal racks 86 for storing tools 88 and other equipment that are needed for various interventions. The station 50 may also have designated areas 92 on the floor of the station 50 to store the tools and equipment.

Figure 3:
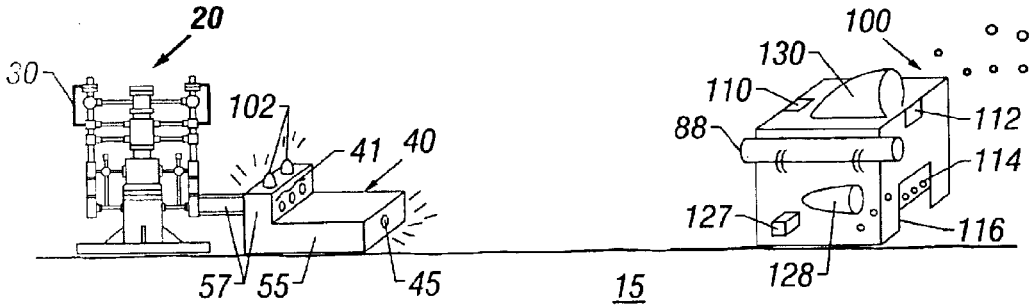
FIG. 3 is an illustration of movement of an underwater vehicle to a subsea well to be serviced according to an embodiment of the invention.

FIG. 3 depicts an underwater vehicle 100 traveling to service a well in accordance with an embodiment of the invention. The underwater vehicle 100 may have a variety of shapes, functions and equipment that are different than those that are depicted in FIG. 3. However, regardless of the specific attributes of the underwater vehicle 100, the underwater vehicle 100 may travel, in some embodiments, untethered to a particular wellhead assembly 20 to perform an intervention on the associated well. In this manner, when the underwater vehicle 100 is in route between the station 50 and the wellhead assembly 20, the underwater vehicle 100 is powered by its own battery 127 and navigates itself to the docking station 40 of the wellhead assembly 20 via the flashing light 45 of the docking station 40.

To perform this navigation, the underwater vehicle 100 may include a front light sensor 110 to track light that is emitted from light source 45 and propeller-driven thrusters (a side thruster 128 and a top thruster 130 depicted as examples in FIG. 3) to direct the underwater vehicle 100 to the light source 45 and thus, direct the underwater vehicle 100 to the docking station 40. As depicted in FIG. 3, the underwater vehicle 100 may travel to the well with equipment and/or tools (a tool 88, for example) to be used in the intervention.

In some embodiments of the invention, the underwater vehicle 100 includes a connector 114 that plugs in, or mates with, the connector 41 of the docking station 40. The underwater vehicle 100 may also include a recessed region, such as a recessed channel 116, that is designed to mate with the docking station 40 to align the underwater vehicle 100 to the docking station 40 for purposes of guiding the underwater vehicle 100 into the docking station 40 to permit the connector 114 to engage the connector 41. As an example, in some embodiments of the invention, the docking station 40 may include a bottom portion 55 that rests on the sea floor 15 and is constructed to mate with the channel 116 to guide the underwater vehicle 100 into the connector 41 that resides on an orthogonal portion 57 of the docking station 40 that extends upwardly from the portion 55.

The docking station 40 may include two additional light sources 102 to aid in precisely positioning the underwater vehicle 100 for purposes of docking. In this manner, a rear light sensor 112 of the underwater vehicle 100 may detect the light from the three light sources 102 and 45 so that the underwater vehicle 100 may use a triangulation technique to back itself onto the portion 55 for purposes of engaging the connector 114 of the underwater vehicle 100 with the connector 41 of the docking station 40. As noted above, the light sources 102 and 45 may be replaced by acoustic transmitters, and the light sensors 110 and 112 may be replaced by sonar transducers, for example.

Figure 4:
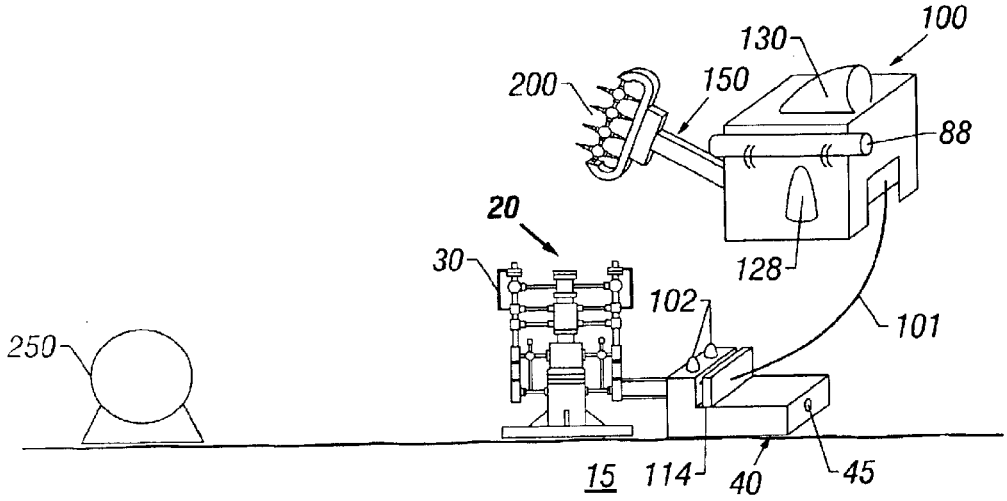
FIG. 4 is an illustration of the vehicle servicing a subsea well according to an embodiment of the invention.

Referring to FIG. 4, once the connector 114 of the underwater vehicle 100 mates with the connector 41 of the docking station 40, the underwater vehicle 100 may then deploy a cable 101 that forms a tethered connection between the connector 114 (that is attached to the docking station 40) and the rest of the underwater vehicle 100. Thus, due to this arrangement, the underwater vehicle 100 may move about the wellhead assembly 20 to perform the intervention while receiving power from the docking station 40, transmitting image signals to the surface and receiving control signals from the surface.

As depicted in FIG. 4, the underwater vehicle 100 may include one or more robotic arms 150 (one robotic arm 150 being shown in FIG. 4) for performing the intervention. As an example, the intervention may include attaching a blowout preventer (BOP) 200 to the well tree so that a tool 88 may be run downhole. In this manner, the ROV 100 may carry the BOP 200 to the well tree 30 from the station 50 and assemble the BOP 200 onto the well tree 30. Subsequently, the underwater vehicle 100 may use coiled tubing from a coil tubing spool 250 that is located near the well tree 30 on the sea floor 15 to lower the tool 88 downhole, as described in U.S. Provisional Patent Application No. 60/225,230, which is hereby incorporated by reference.

After the intervention, a command may be communicated downhole for the underwater vehicle 100 to undock itself from the docking station 40. Alternatively, an operator at the surface may operate the underwater vehicle 100 to undock itself from the docking station 40. For example, the undocking may include the underwater vehicle 100 signaling the connector 114 to disconnect from the docking station 40. After disconnection, the underwater vehicle 100 then retracts the cable 101, thereby reattaching the connector 114 to the main body of the underwater vehicle 100. After undocking, the light sources 45 and 102 of the station 50 are turned on so that the underwater vehicle 100 may guide itself back to the station 50. Alternatively, the light sources 45 and 102 of another docking station 40 may be turned on to guide the underwater vehicle 100 to pick up parts from one of the regions 62 or to guide the underwater vehicle 100 to another wellhead assembly 20 for another intervention.

Figure 5:
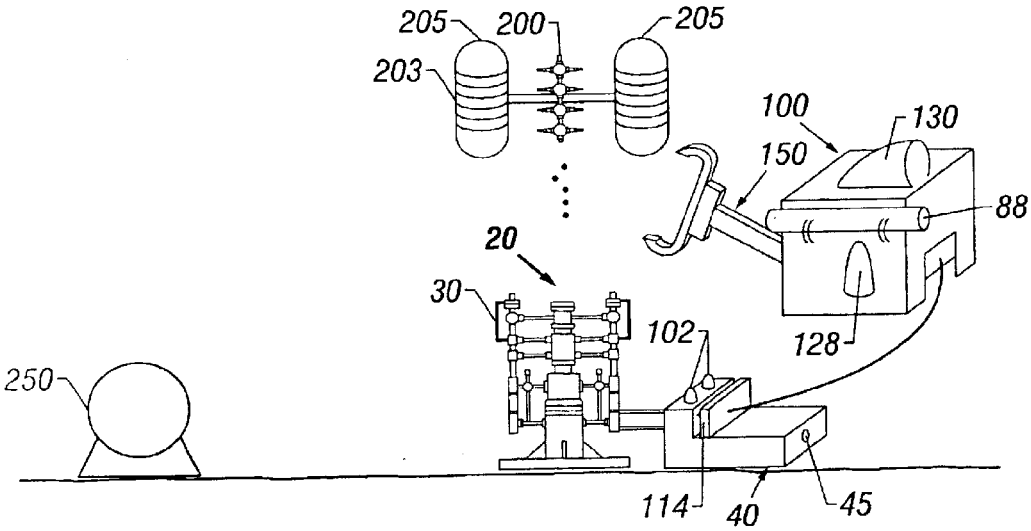
FIG. 5 is an illustration of the vehicle sending a part to the surface of the sea according to an embodiment of the invention.

It is possible that a particular tool or piece of equipment downhole may totally fail or not function properly. When this happens, the underwater vehicle 100 may be used to send the failed or defective equipment or tool to the surface. For example, referring to FIG. 5, a BOP 200 that mounted to the well tree may fail. Upon this occurrence, the underwater vehicle 100 is dispatched to the wellhead assembly 20 to remove the BOP 200. The underwater vehicle 100 may carry a buoyant assembly 203 (that include buoyant tanks 205) to the wellhead assembly 20 to attach to the BOP 200 after the BOP 200 is removed. In this manner, after attaching the assembly 203 to the BOP 200, the underwater vehicle 100 releases the assembly 203 to carry the assembly 203 to the surface where the BOP 200 may be picked up for service. In some embodiments of the invention, the assembly 203 may include a global positioning satellite (GPS) receiver to, when the assembly 203 surfaces, determine the position of the assembly 203. A satellite telephone or other transmitter of the assembly 203 may then communicate the assembly's position to a surface vessel.

Not only may the underwater vehicle 100 be used to send parts to the surface, the underwater vehicle 100 may also be used to retrieve parts that are dropped from the surface. For example, the underwater vehicle 100 may be docked in the station 50 and receive a communication that informs the underwater vehicle 100 that a part has been or will be dropped down to one of the regions 62 (see FIG. 1). This part may be dropped to maintain or increase the inventory of parts that are stored in the station 50 or may be dropped for use in an upcoming intervention. Thus, the underwater vehicle 100 may depart from the station 50 to the identified region 62 to pick up the part.

Figure 6:
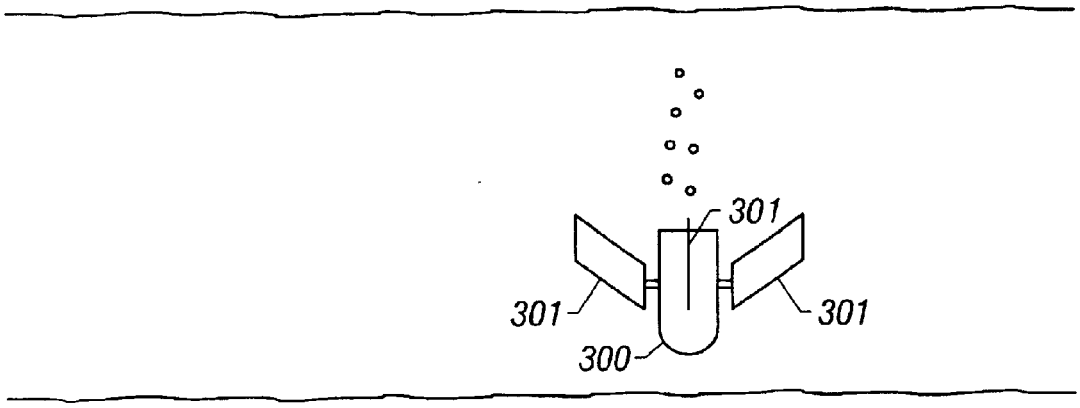
FIG. 6 is an illustration of a part being dropped to a designated subsea receiving region according to an embodiment of the invention.
Figure 6:
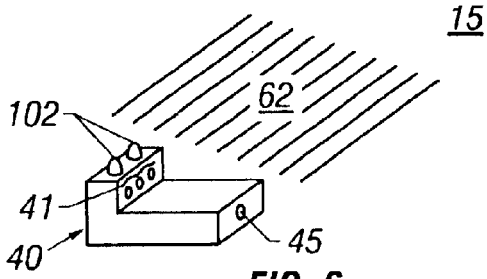

As an example, referring to FIG. 6, a finned assembly 300 may be used to drop a part (that is contained within the finned assembly 300) to one of the regions 62. In this manner, the docking station 40 near the region 62 is alerted when a drop is to be made to the region 62. To guide the assembly 300 to the region 62, the docking station 40 flashes its light 45. The assembly 300 is dropped from the surface in the proximity of the region above the region 62. The assembly 300 includes a light sensor to detect the light 45, and the assembly 300 controls the positions of its fins 301 to guide the assembly 300 to the region 62. The underwater vehicle 100 may then dock to the docking station 40 and remove the part from the assembly 300 before undocking from the docking station 40 and returning to the station 50 with the part. In some embodiments of the invention, the underwater vehicle 100 may attach buoyancy tanks to the finned assembly 300 after removing the part from the assembly 300 to send the assembly 300 back to the surface where the assembly 300 may be retrieved.

The above-described components may be used as a system as described above but may also have application individually or with other systems. For example, the component for dropping and retrieving the tools may be used in a conventional subsea intervention with an ROV tethered to a surface vessel.

Figure 7B:
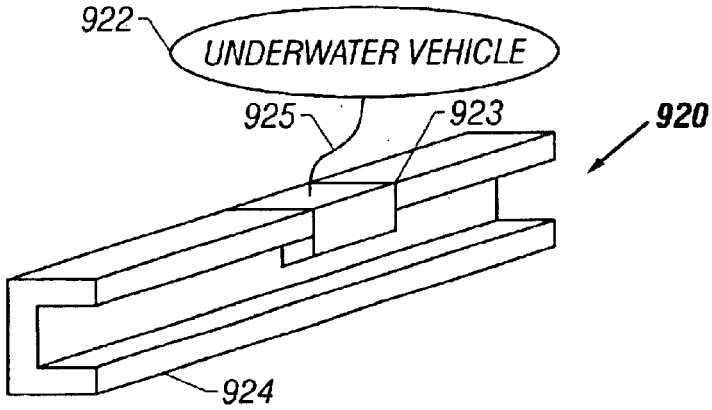
FIG. 7B is an illustration of the connection of an underwater vehicle to a track.

Other embodiments are within the scope of the following claims. For example, referring to FIG. 7, the system 10 may be replaced by a system 400, in some embodiments of the invention. Unlike the system 10, the system 400 includes underwater vehicle tracks 414 that are supported by the sea floor 15, extend between the wellhead assemblies 20 and extend between the regions 62 and the station 50.

More specifically, each track 414 is constructed to guide the underwater vehicle 100 from a point near the station 50 to either a region 62 or a wellhead assembly 20. In some embodiments of the invention, the station 50 is mounted to a turntable 410 that is also located on the sea floor 15. The turntable 410 includes a short track 412 that is extends inside the station 50 so that when the underwater vehicle is inside the station 50, the underwater vehicle is resting on the track 412. The turntable 410 may pivot to align the track 412 with one of the tracks 414, depending on the particular region 62 or wellhead assembly 62 to be visited by the underwater vehicle.

Figure 7A:
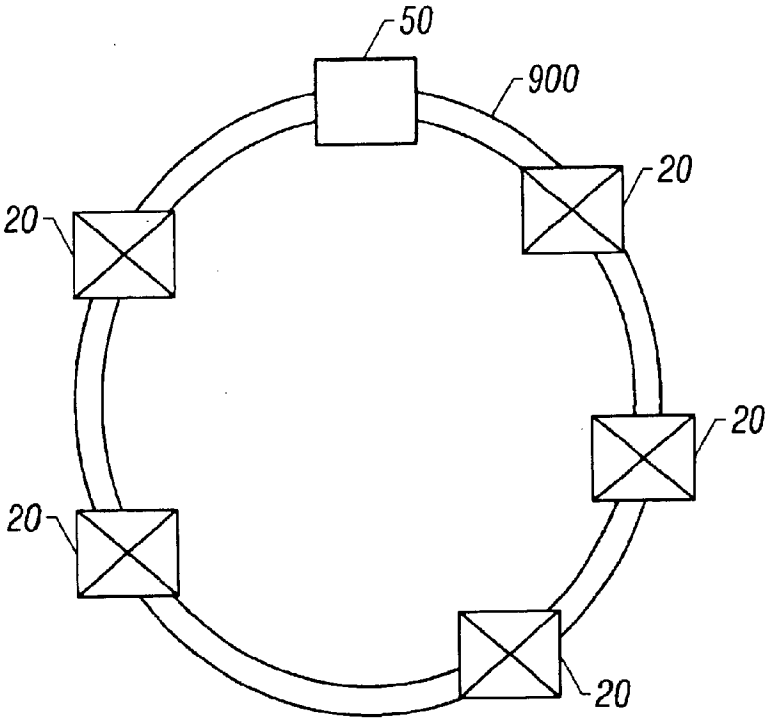
Figure 7:
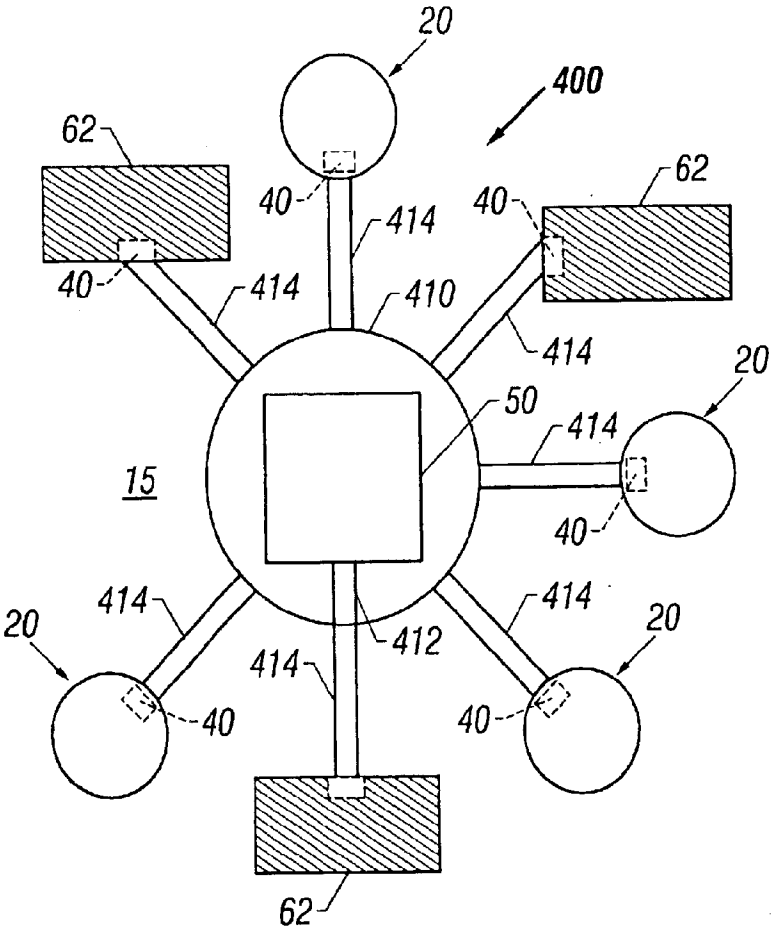

Alternatively, the track could make a circuit, or closed loop, with the wellhead assemblies 20 and the station 50 forming points along the loop, as depicted in FIG. 7A that depicts an embodiment 900 of such as track.

The underwater vehicle is connected to the docking station while inside the station 50 and is connected to a docking station 40 when the underwater vehicle is at a region 62 or wellhead assembly 20. In between docking stations 40, the underwater vehicle is not connected to communicate with the surface or receive power, in some embodiments of the invention.

Among the other features of the system 400, in some embodiments of the invention, electromagnetic coils may be embedded in each track 414 to interact with permanent magnets (for example) in the underwater vehicle for purposes of propelling the underwater vehicle along the track 414. Alternatively, the underwater vehicle may propagate along the track 414 via its propeller-driven thrusters. When the underwater vehicle is located at a particular wellhead assembly 20 or region 62, the underwater vehicle may not leave the track 414, in some embodiments of the invention. In this manner, robotic arms of the underwater vehicle may extend from the main body of the underwater vehicle to perform various functions of the underwater vehicle while the main body of the underwater vehicle remains mounted to the track 414. Alternatively, in other embodiments of the invention, the underwater vehicle may disengage from the track and use propeller-driven thrusters and a tethered connection to the docking station 40 or to a track to move about to perform various functions.

For example, FIG. 7B depicts an embodiment 920 in which an underwater vehicle 922 has a tethered connection (via a cable 925) to a clamp 923 that slides along a track 924. In this manner, the track 924 may serve as a communication conduit or include electrical communication lines that permit the underwater vehicle 922 to communication with the docking station 50. The underwater vehicle 922 may, for example, be engaged to the clamp 923 until the underwater vehicle 922 is near a wellhead assembly 20 to be serviced, and then the underwater vehicle 922 may disengage itself from the clamp 923 to service the wellhead assembly 20. After servicing the wellhead assembly 20, the underwater vehicle 922 may then engage the clamp 923 and slide along the track 924 to the station 50 or another wellhead assembly 20. Other variations are possible.

Figure 8:
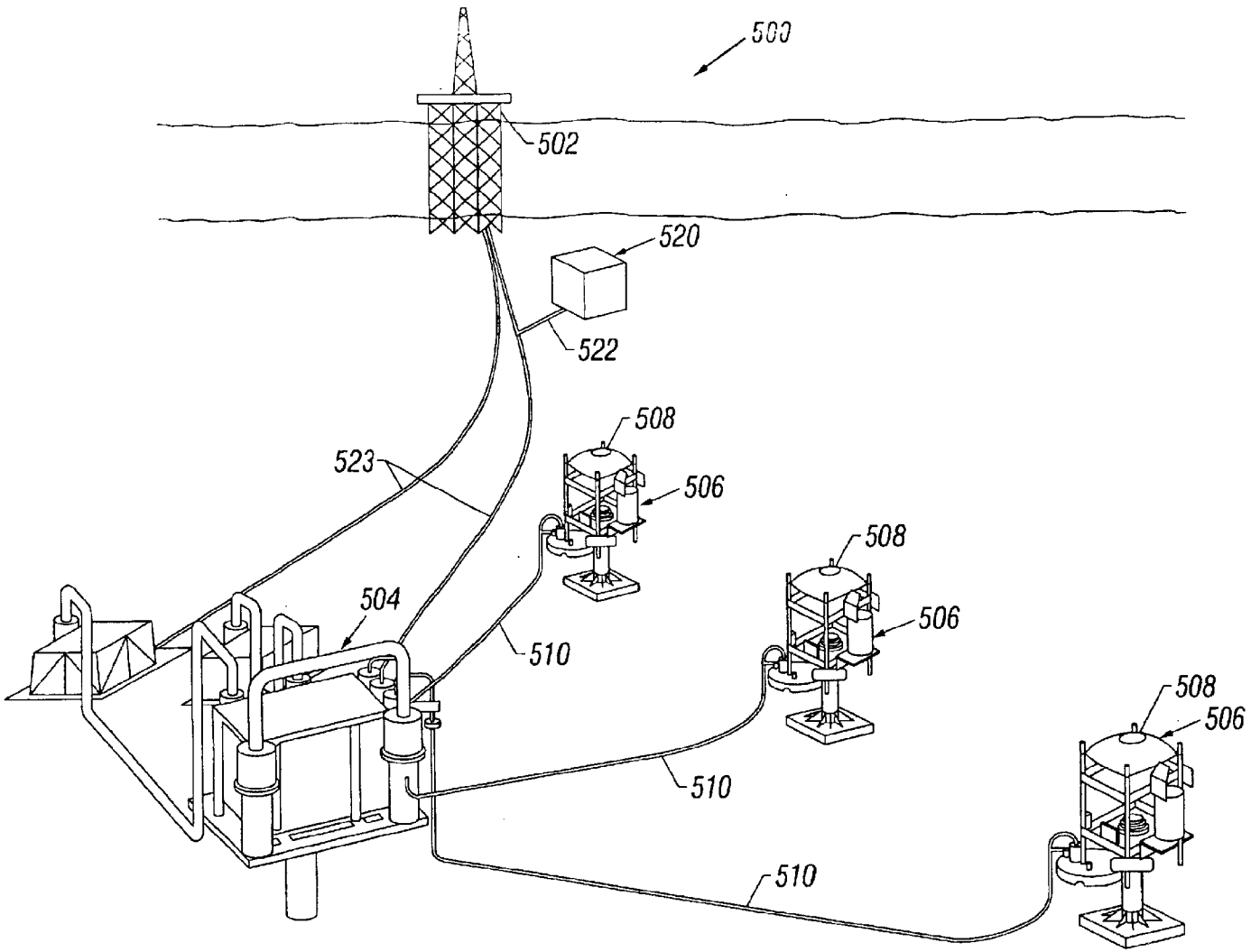

As another example of an embodiment of the invention, more than one underwater vehicle may be housed and docked in the station 50. Thus, interventions may occur concurrently and/or more than one underwater vehicle may assist in a particular intervention. For example, FIG. 8 depicts a subsea production system 500 that includes a station 520 that is located on the sea floor and houses multiple underwater vehicles. The station 520 communicates with a host platform 502 via communication lines 522 that extend along the sea floor between the station 520 and the host platform 502. The communication lines 522 are part of cables and pipes (indicated by reference numeral "523") that establish fluid and electrical communication between the host platform 502 and subsea wellhead assemblies 506, assemblies 506 that may each provide an ROV docking station, as described above. As depicted in FIG. 8, the subsea production system 500 may include a manifold 504 that distributes and directs electrical and fluid communication from the host platform 502 to the wellhead assemblies 506 via electrical and fluid communication lines 510 that extend to the various wellhead assemblies 506.

Figure 9:
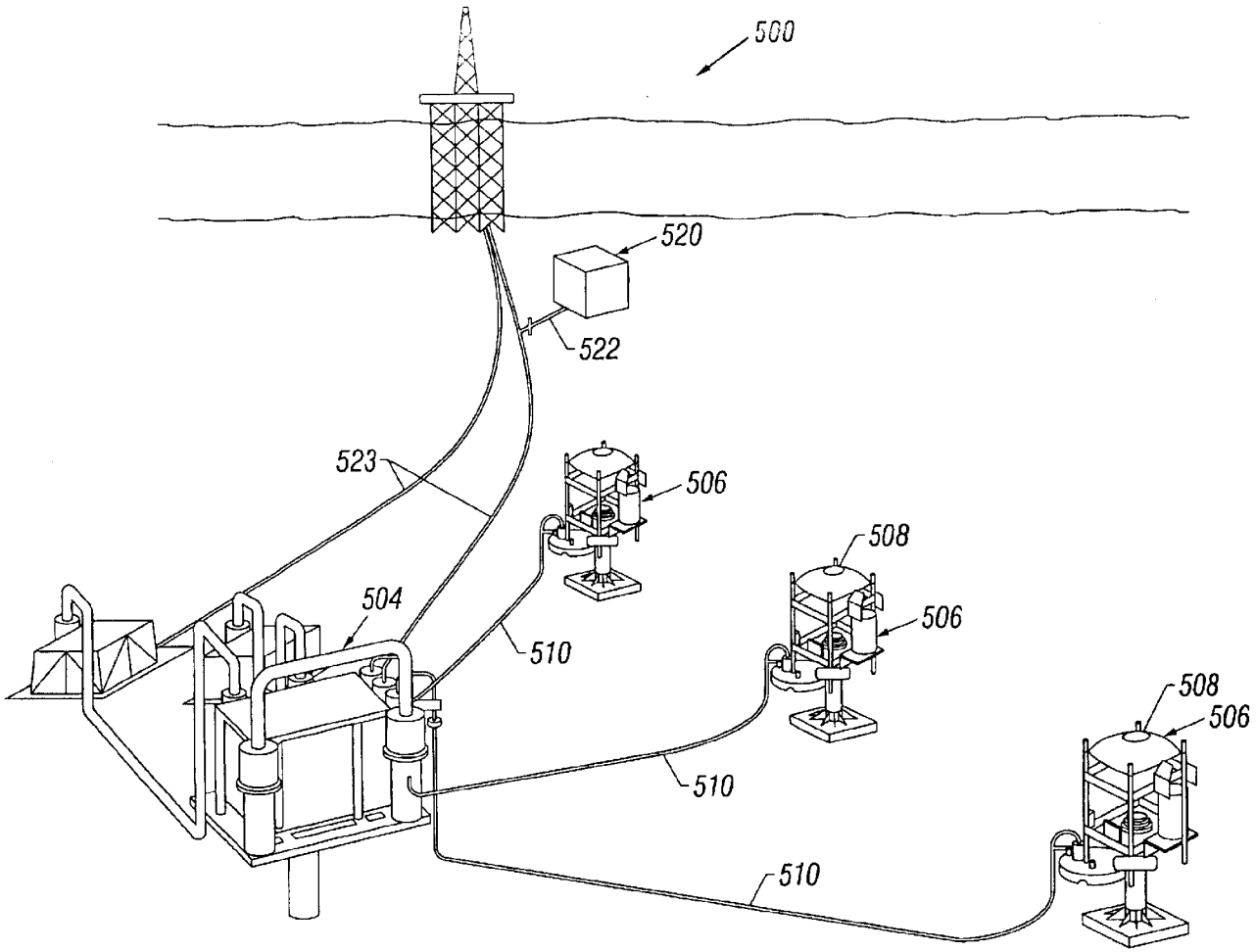
FIGS. 9, 10, 11, 12, 13, 14, 15, 16 and 17 depict a sequence of operations by a remotely operably vehicle of the subsea production system of FIG. 8 according to an embodiment of the invention.

Referring to FIG. 9, each of the wellhead assemblies 506 has a tree cap 508 that is removed before the associated subsea well may be serviced by an underwater vehicle from the station 520. As an example, the tree cap 508 may be removed by one of these underwater vehicles or may be removed via an intervention from the surface of the sea.

Figure 10:
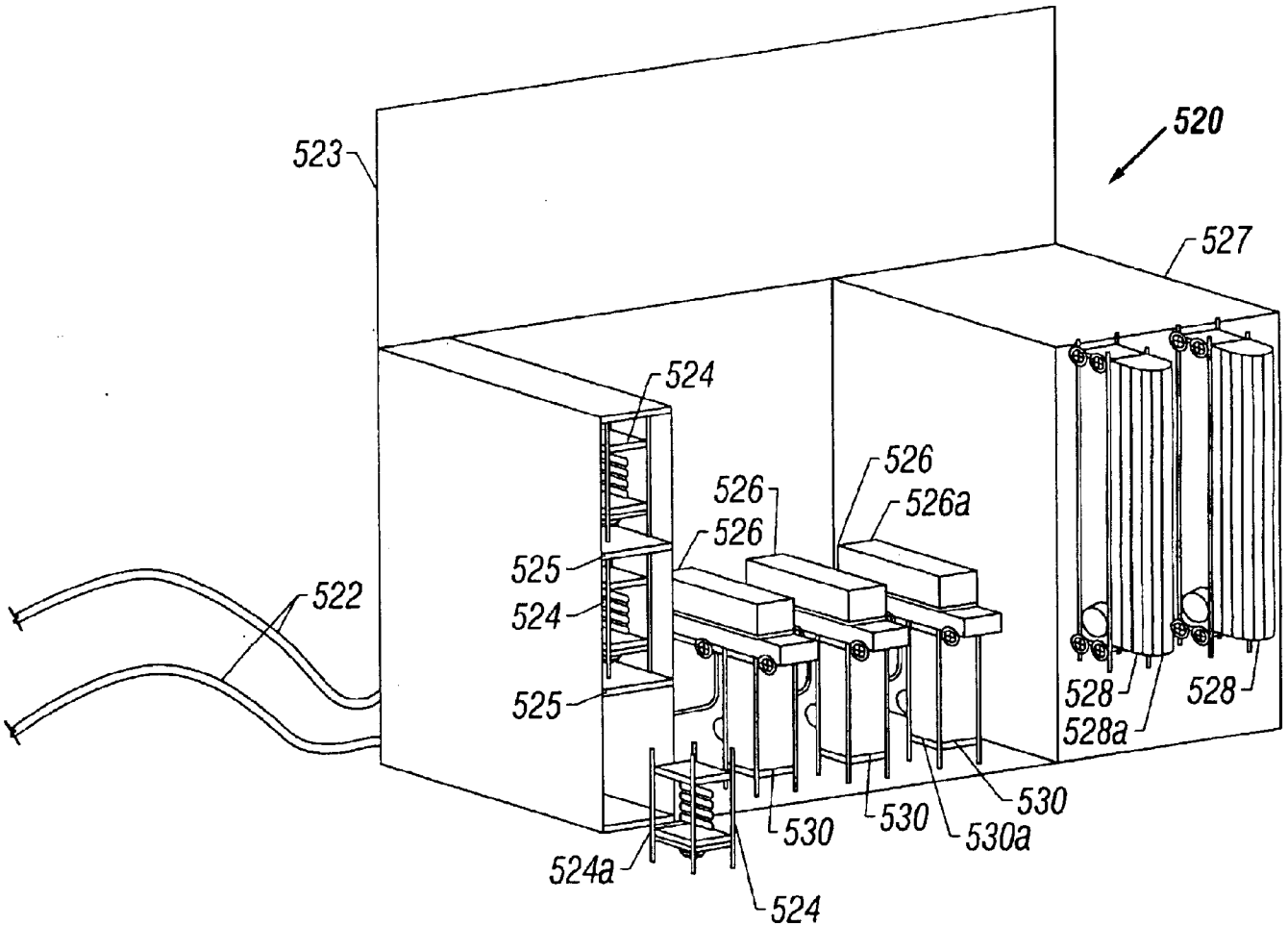

FIG. 10 depicts one embodiment of the station 520. As shown, the station 520 houses multiple underwater vehicles 526 as well as equipment that is used by the underwater vehicles for purposes of performing interventions. As an example of this equipment, in some embodiments of the invention, the station 520 includes well control packages 524, carousels 528 and conveyance modules 530. As described below, depending on the particular intervention desired, an underwater vehicle selectively assembles this equipment to form an assembly 540 (see FIG. 17) that the underwater vehicle carries and assembles to the appropriate well head assembly 506 (see FIG. 9).

Still referring to FIG. 10, each well control package 524 is essentially a tree that is used for well control during an intervention. Thus, the well control package 524 forms the bottom of the assembly 540 (see FIG. 17). In this manner, the tree of the wellhead assembly 506 (see FIG. 9) is constructed for managing flow control but not for controlling the well during an intervention. Thus, the well control package 524 supplements the tree of the wellhead assembly 506 by providing, for example, the needed seals and rams that are constructed to cut wire or coiled tubing (as examples) to shut off the subsea well if necessary to prevent a blowout.

Each carousel 528 contains tools that are selectable during an intervention operation. In this manner, the selected tool may be lowered downhole during the intervention via wireline, coiled tubing or a slickline (as examples). Thus, as examples, in some embodiments of the invention, some of the carousels 528 may contain wireline deployed tools and other carousels 528 may contain coiled tubing deployed tools. Other carousels 528 may contain tools that are deployed using over deployment delivery systems (a slickline or a dart-based delivery system, as examples). The carousel 528 typically is mounted on top of the well control package 524 in the assembly 540 (see FIG. 17).

Each conveyance module 530 is associated with a particular delivery system (coiled tubing delivery system, wireline delivery system, etc.) and is used in connection with a compatible one of the carousels 528. For example, a conveyance module 530 that contains a spool of coiled tubing is used in an intervention in conjunction with a carousel 528 that houses coiled tubing deployed tools. The conveyance module 530 also includes the controls, circuitry, sensors, etc. needed to deploy the wireline, slickline or coiled tubing (as examples) downhole, control the downhole tool and monitor any measurements that are obtained by the downhole tool. The conveyance module 530 may or may not be used in the intervention. For example, some interventions may only use dart tools, for example, that do not have tethered connect ions.

After the assembly 540 (see FIG. 17) that contains the conveyance module 530 is docked to the wellhead assembly 506 (see FIG. 9, for example) to perform the intervention, the conveyance module 520 may communicate with the host platform 502 via the communication lines 512.

Referring to FIG. 10, in some embodiments of the invention, the station 520 may be at least a partially enclosed structure (a stainless steel box-like structure or a plastic dome-like structure (not shown in FIG. 2), as examples) that has a front opening to receive the underwater vehicles 526 when docked. In some embodiments of the invention, the front opening may be closed by a door (not shown) to form a sealed enclosure. As depicted in FIG. 10, a top panel 523 of the station 520 may be pivoted about a hinged connection to temporarily remove the ceiling of the station 520 to allow sufficient space for an underwater vehicle 526 to maneuver inside the station 520 when assembling equipment together to form the final assembly 540, as described below. Similar to the Station 50, the station 520 includes docking stations (not shown) and associated connectors for the underwater vehicles 526 for establishing power and communication connections for the underwater vehicles 526 when docked inside the station 520. A light source, acoustic telemetry device, electromagnetic device, laser or other guidance mechanism (not shown) may be located on the exterior of the station 520 for purposes of guiding underwater vehicles 526 to and from the station 520, as described above.

The equipment of the station 520 may be organized in many different arrangements inside the station 520. One such arrangement is described below.

FIG. 10 depicts an arrangement in which the conveyance modules 530 are stored on the floor of the station 520, and each underwater vehicle 526 that is not currently being used is stored on top of one of the conveyance modules 530. In this position, each underwater vehicle 526 connects into an associated docking station (not shown). The carousels 528 are attached to the exterior of a rectangular storage container 527 of the station 520, and each well control package 524 is stored on a shelf 525 of the station 520. The storage container 527 may be used to store additional equipment inside the station 520 and is accessible from its top opening when the top panel 523 is pivoted open, as depicted in FIG. 10.

Figure 11:
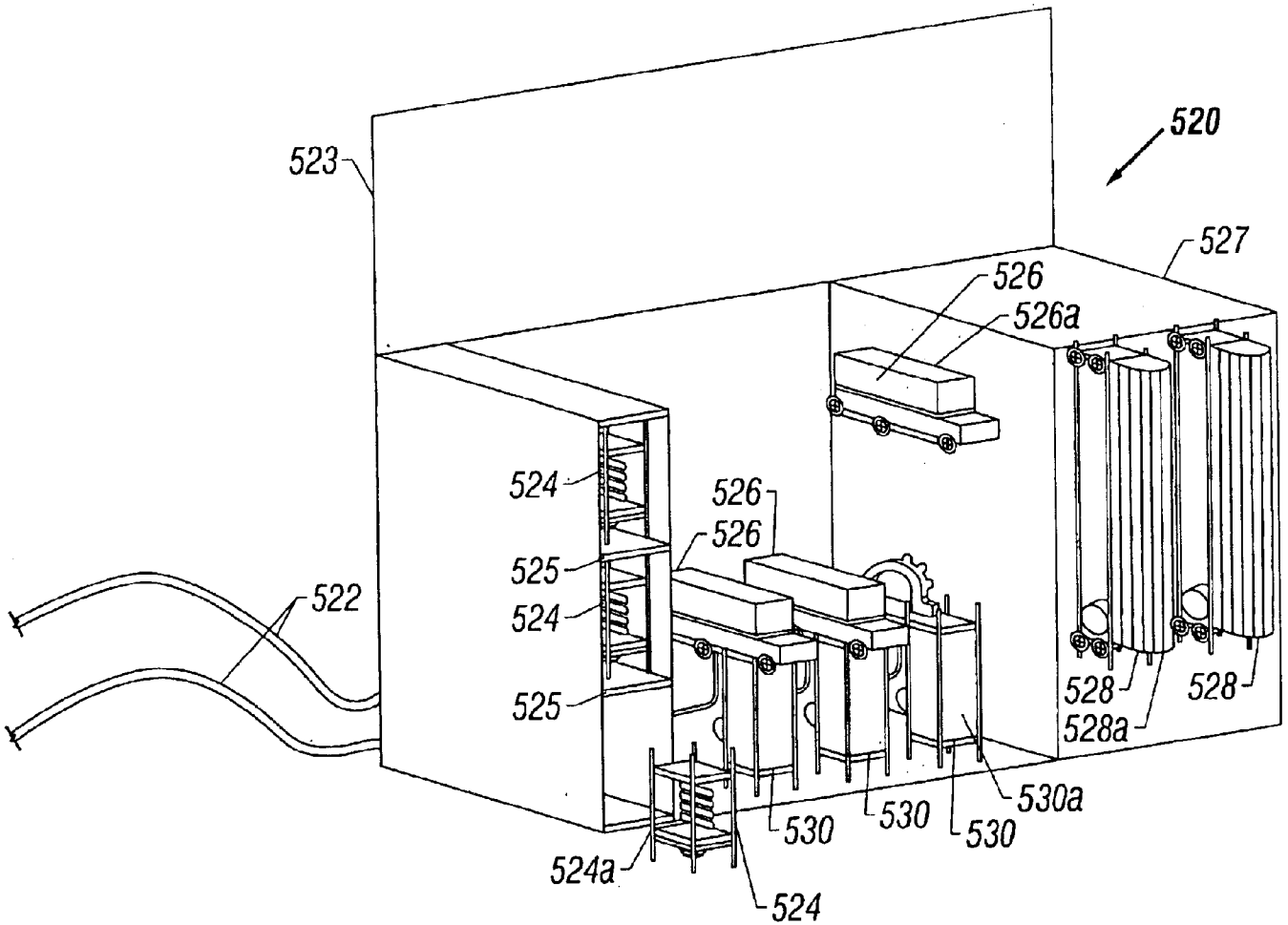

FIGS. 11–17 depict a scenario in which an underwater vehicle 526 responds to commands that are communicated to the station 520 from the host platform 502 for purposes of performing an intervention in one of the subsea wells. For this scenario, it is assumed that the tree cap 506 from the wellhead assembly 508*a* (one of the wellhead assemblies 508 that are depicted in FIG. 9) has already been removed (by one of the underwater vehicles 526, for example). Furthermore, for this scenario, it is assumed that an underwater vehicle 526 has removed one 524*a* of the well control packages 524 from its associated shelf 525 and placed the well control package 524 outside of the station 520, as depicted in FIG. 11.

To perform the intervention, the underwater vehicle 526 gathers and assembles the components of the assembly 540 (see FIG. 17) that is mounted to the wellhead assembly 508*a* for purposes of performing the intervention. Still referring to FIG. 11, in this manner, in response to the commands from the host platform 502, one of the underwater vehicles 526 (the underwater vehicle 526*a* for the scenario described herein) detaches itself from the conveyance module 530 (such as the conveyance module 530*a*, for example) to which the underwater vehicle 526 is currently docked. In some embodiments of the invention, the underwater vehicle 526 that is used in the intervention may be selected based on the delivery system that is used by the conveyance module 530 to which the underwater vehicle 526*a* is docked. For example, if a wireline-based intervention is needed, then an underwater vehicle 526 that is initially docked to a conveyance module 530*a* that uses a wireline-based delivery system may be selected.

Figure 12:
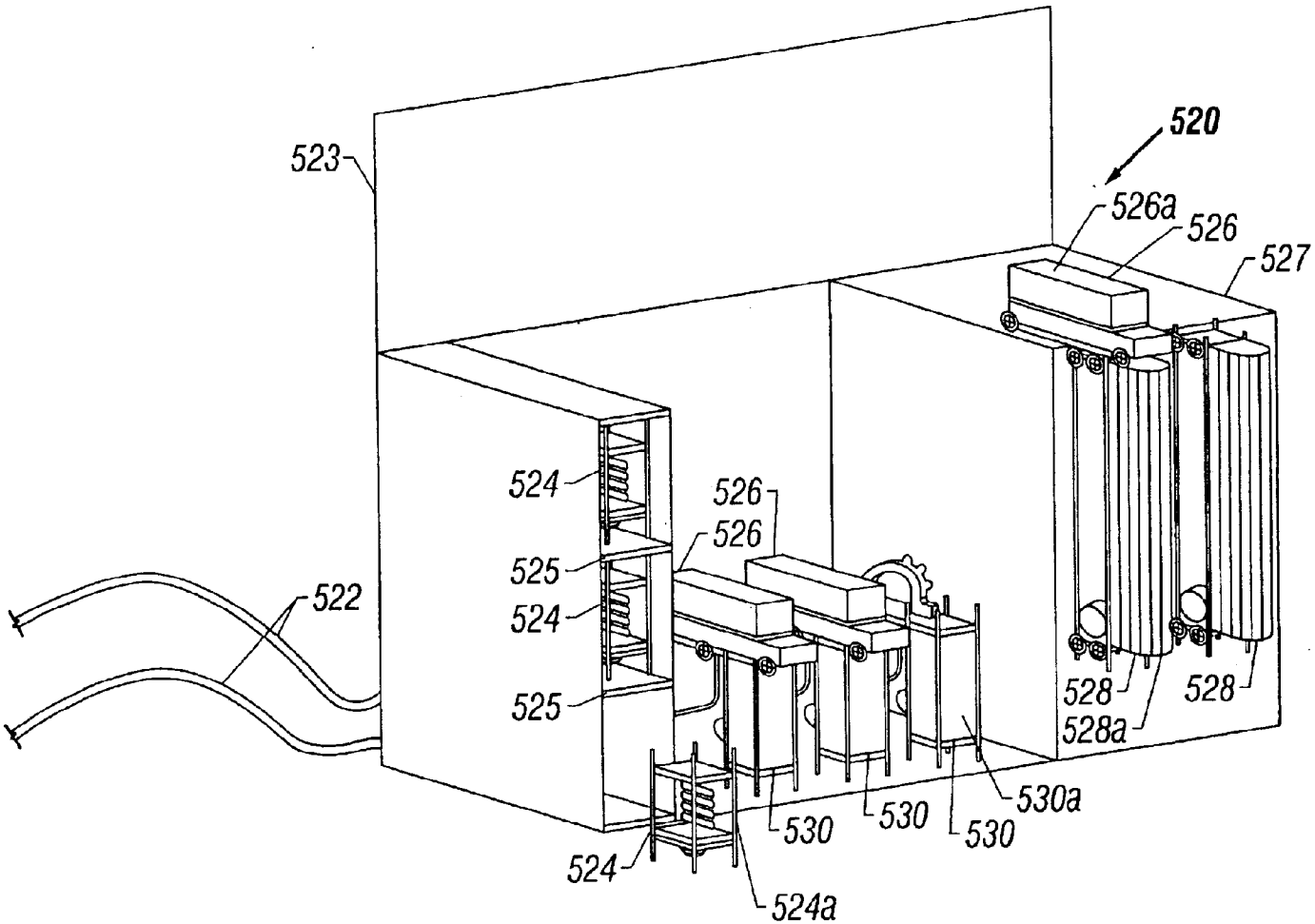

After detaching itself from the conveyance module 530*a*, the underwater vehicle 526*a* docks to one 528*a* of the carousels 528, as depicted in FIG. 12. The selected carousel 528*a* is chosen based on the tools inside the carousel 528*a* and the selected delivery system. For example, the carousel 528*a* may contain wireline-based tools and be chosen because a wireline-based intervention is to be performed.

Figure 13:
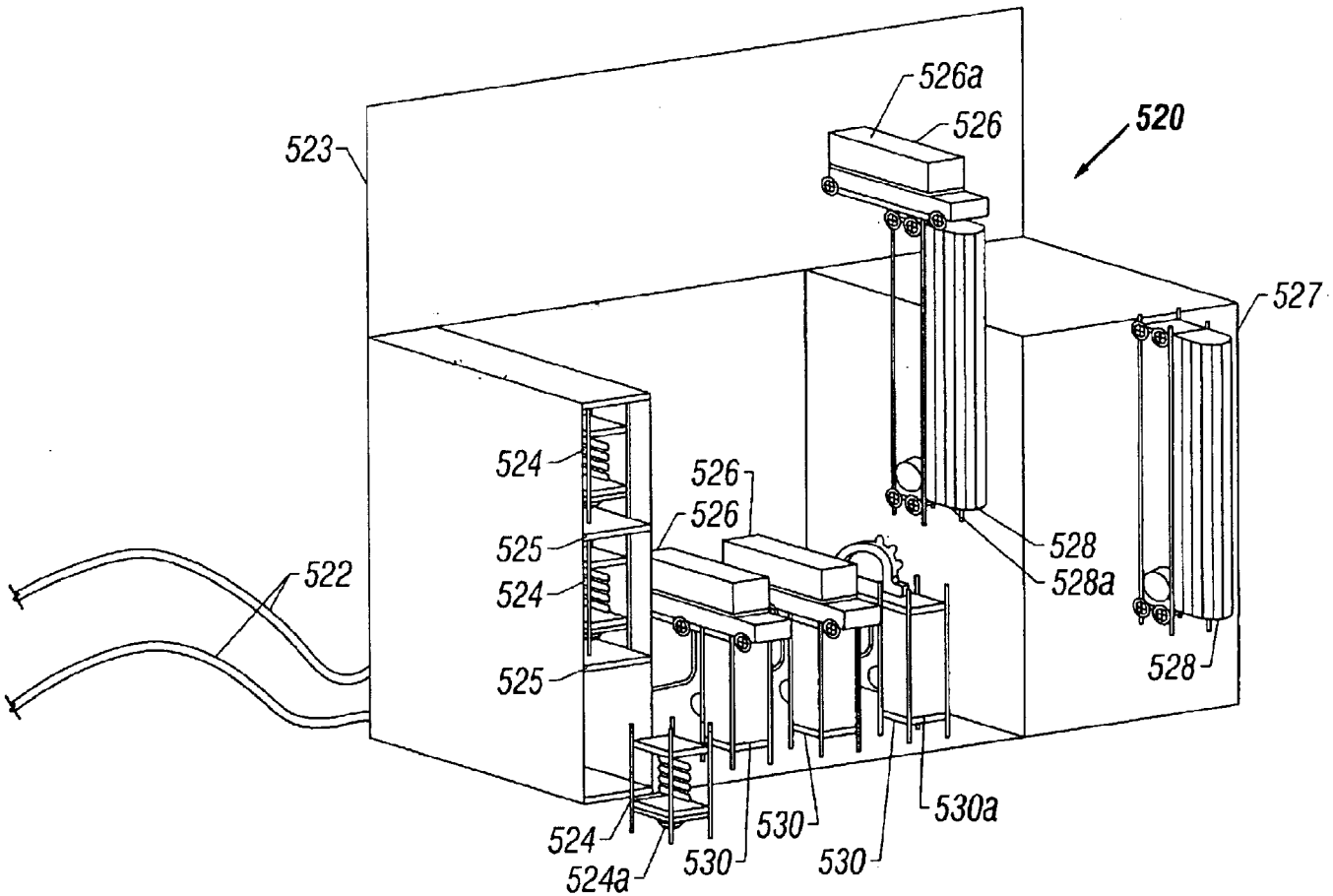
Figure 14:
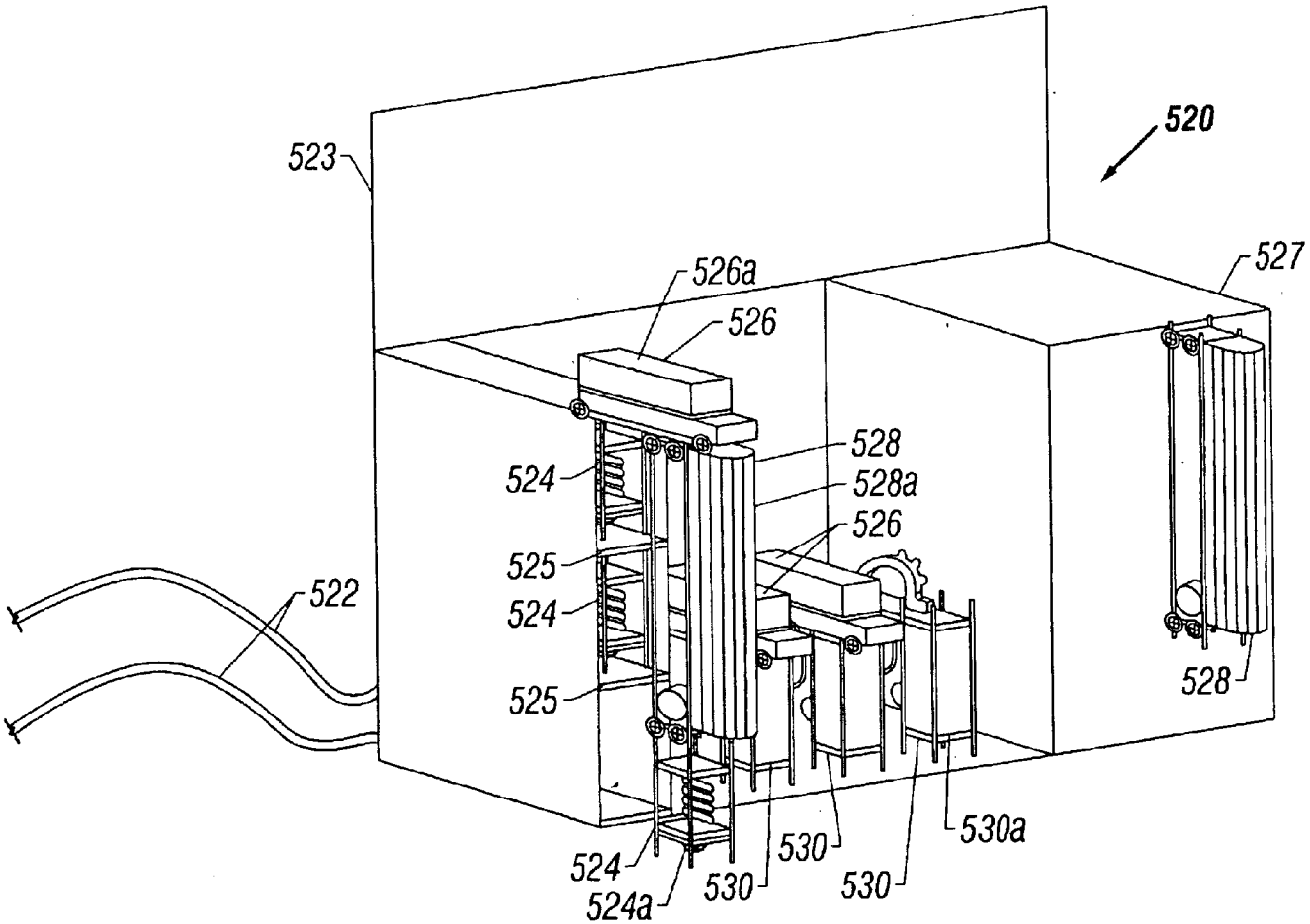
Figure 15:
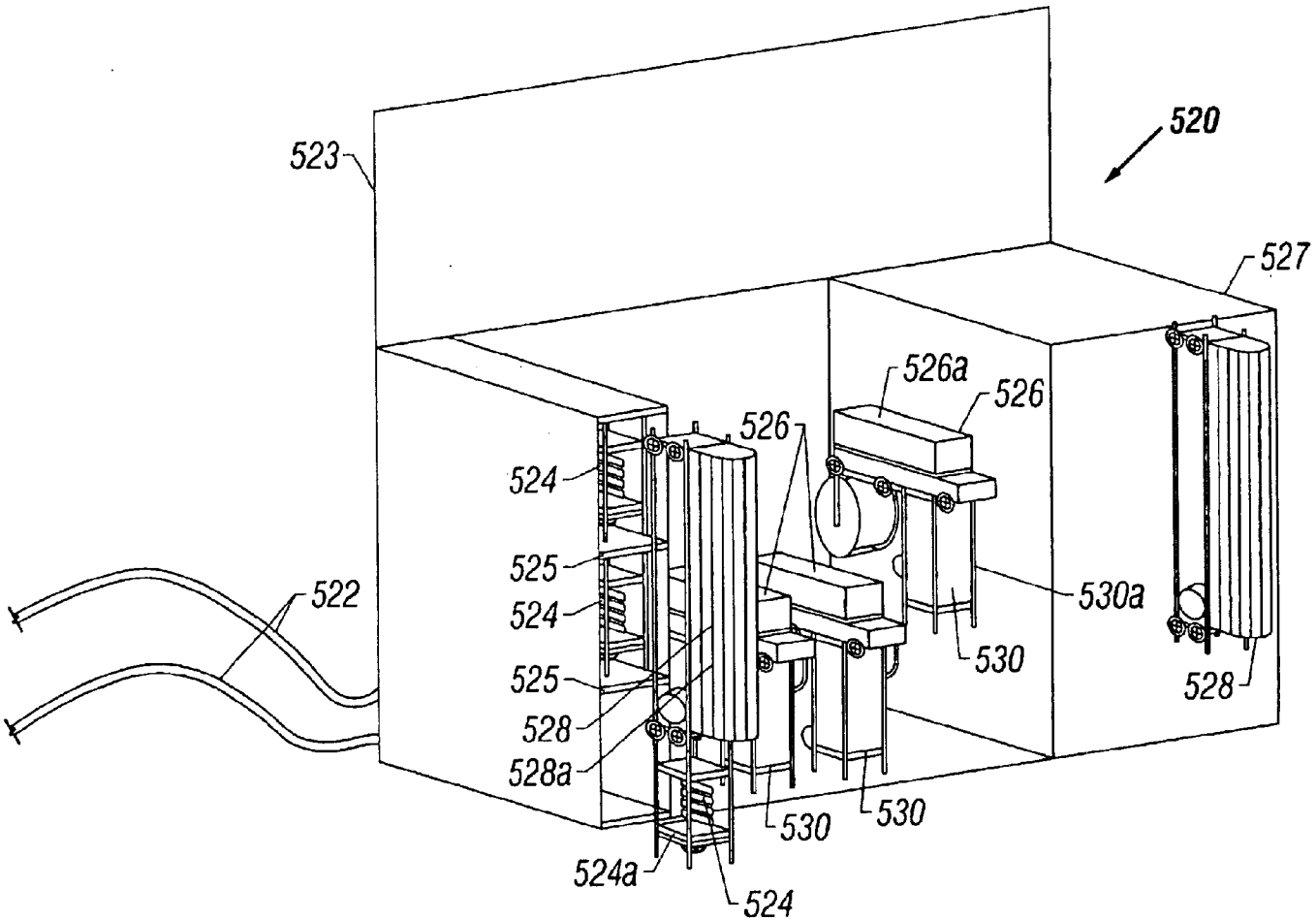
Figure 16:
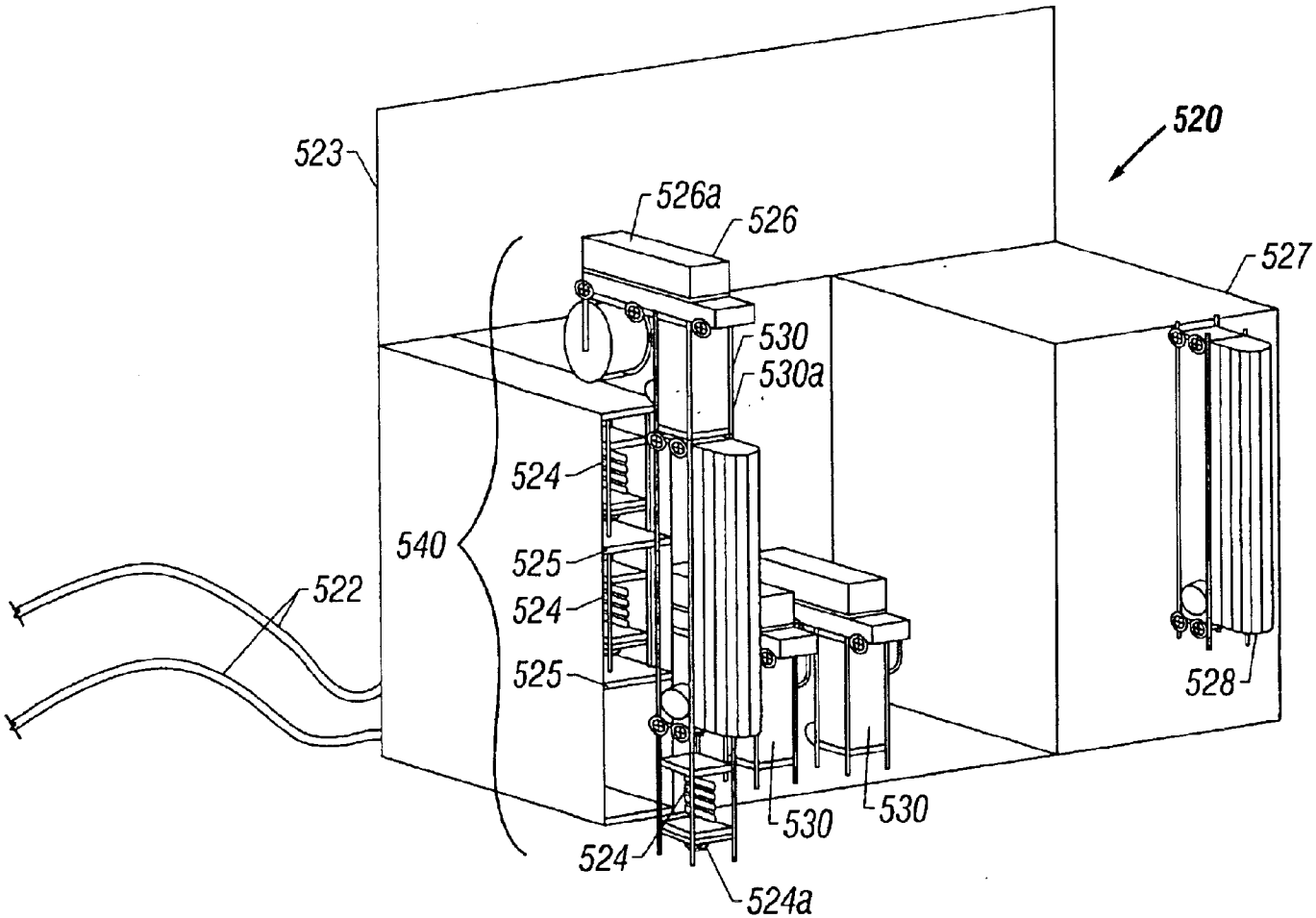
Figure 17:
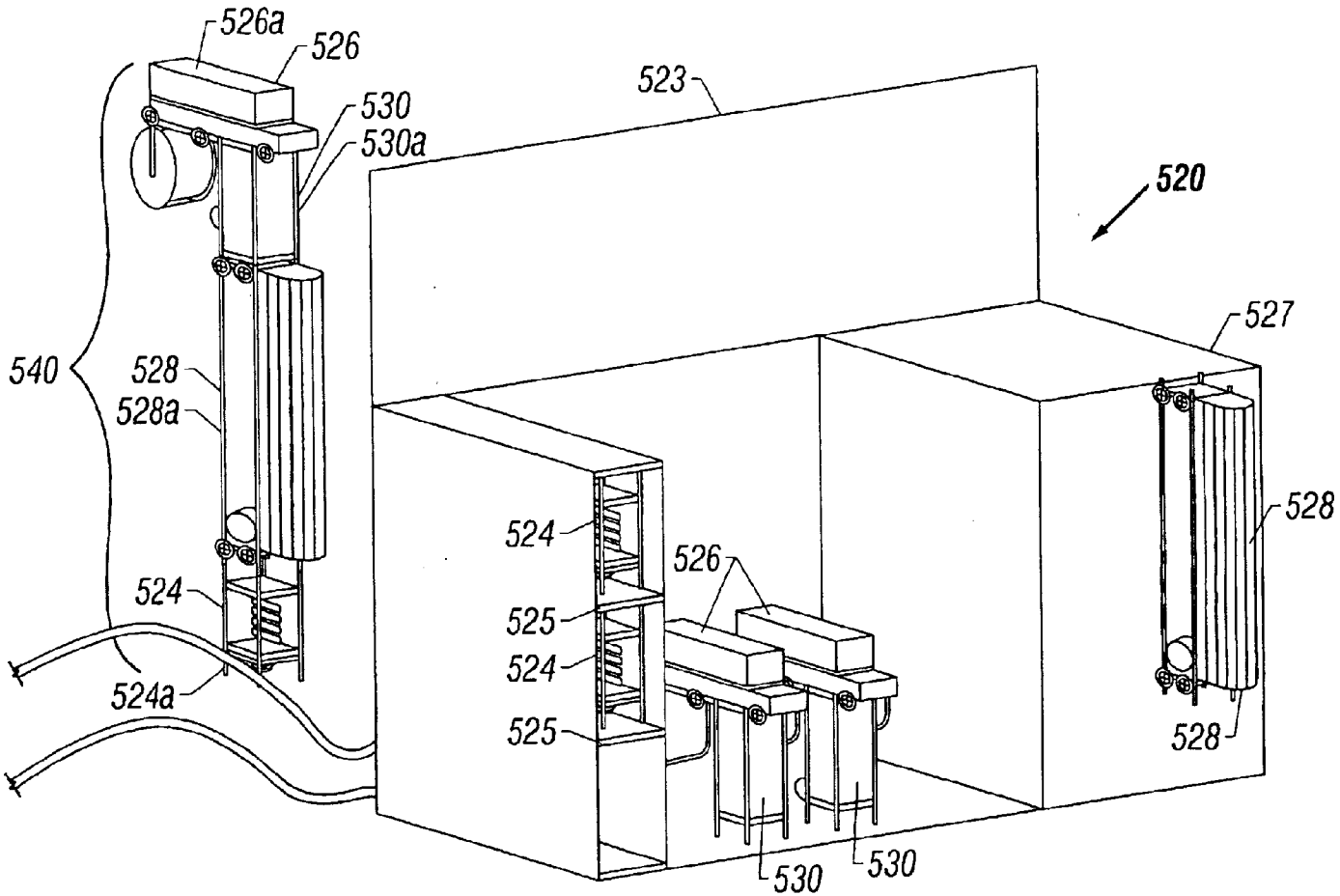

As depicted in FIG. 13, after the underwater vehicle 526*a* docks to the carousel 528*a*, the underwater vehicle 526*a* causes the carousel 528*a* to disengage itself from the storage container 527. Next, the underwater vehicle 526*a* carries the carousel 528*a* to a position on top of the well control package 524*a* so that the carousel 528*a* may dock to the well control package 524*a*, as depicted in FIG. 14. Subsequently, the underwater vehicle 526*a* returns to ROV station 520 to attach itself to and pick up the conveyance module 530*a*, as depicted in FIG. 15. Next, the underwater vehicle 526*a* places the conveyance module 530*a* on top of the carousel 528*a* so that the conveyance module 520*a* may dock to the carousel 528*a* and complete the assembly 540 to perform the intervention, as depicted in FIG. 16. Lastly, the underwater vehicle 526*a* carries the assembly 540 to the wellhead assembly 506 where an intervention is to be performed, as depicted in FIG. 17 and docks with the assembly 540 to the wellhead assembly 506. Once this occurs, an operator at the host platform 502 may communicate with circuitry of the conveyance module 520*a* and the carousel 528 to control intervention into the well.

In some embodiments of the invention, the tools of the carousel 528 may be used to, for example, remedy or diagnose a problem in a subsea well. For example, as described below in some embodiments of the invention, the tools of the carousel 528 may be used to correct a problem in the subsea well. The tools of the carousel 528 may also be used to test the subsea well at various depths, for example, to determine a composition of the well fluids that are being produced by the well. The results of this test may indicate, for example, that a particular zone of the well should be plugged off to prevent production of an undesirable fluid. Thus, in this manner, the system may plug off the affected zone of the well. The testing of well fluid composition and the above-described setting of the plug intervention are just a few examples of the activities that may be performed using the tools of the carousel 528 in an intervention.

Figure 18:
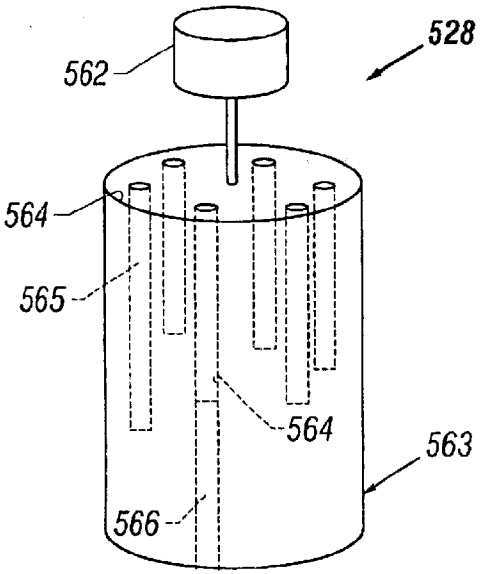
FIG. 18 is a schematic diagram of a tool carousel assembly according to an embodiment of the invention.

Referring to FIG. 18, in some embodiments of the invention, the carousel 528 includes a carousel assembly 563 that holds various tools 565, such as tools to diagnosis the well and tools to remedy problems in the well. The carousel 528 includes a housing (not shown) that forms a sealed enclosure for the carousel assembly 563, as well as connectors to establish mechanical, electrical and possibly fluid communications with the conveyance module 530 and well control package 524.

In some embodiments of the invention, the carousel 528 includes a motor 562 that rotates the carousel assembly 563 to selectively align tubes 564 of the carousel assembly 563 with a tubing 566 that is aligned with the central passageway of the well control package 524. Each of the tubes 564 may be associated with a particular tool (also called a "dart"), such as a plug setting tool, a pressure and temperature sensing tool, etc. Besides darts, the tools may also include other types of tools, such as wireline, slickline and coil tubing-based tools, as just a few examples.

For embodiments in which the tools are lowered downhole via a tethered connection, the carousel assembly 563 mates with the appropriate conveyance module 530 for purposes of obtaining the wireline, slickline or coiled tubing needed for deployment of the tool. As described above, the conveyance module 530 controls deployment of the wireline, slickline or coiled tubing and may control operation of the downhole tool, as well as receive measurements from the downhole tool and communicate these measurements to the host platform 502.

Figure 19:
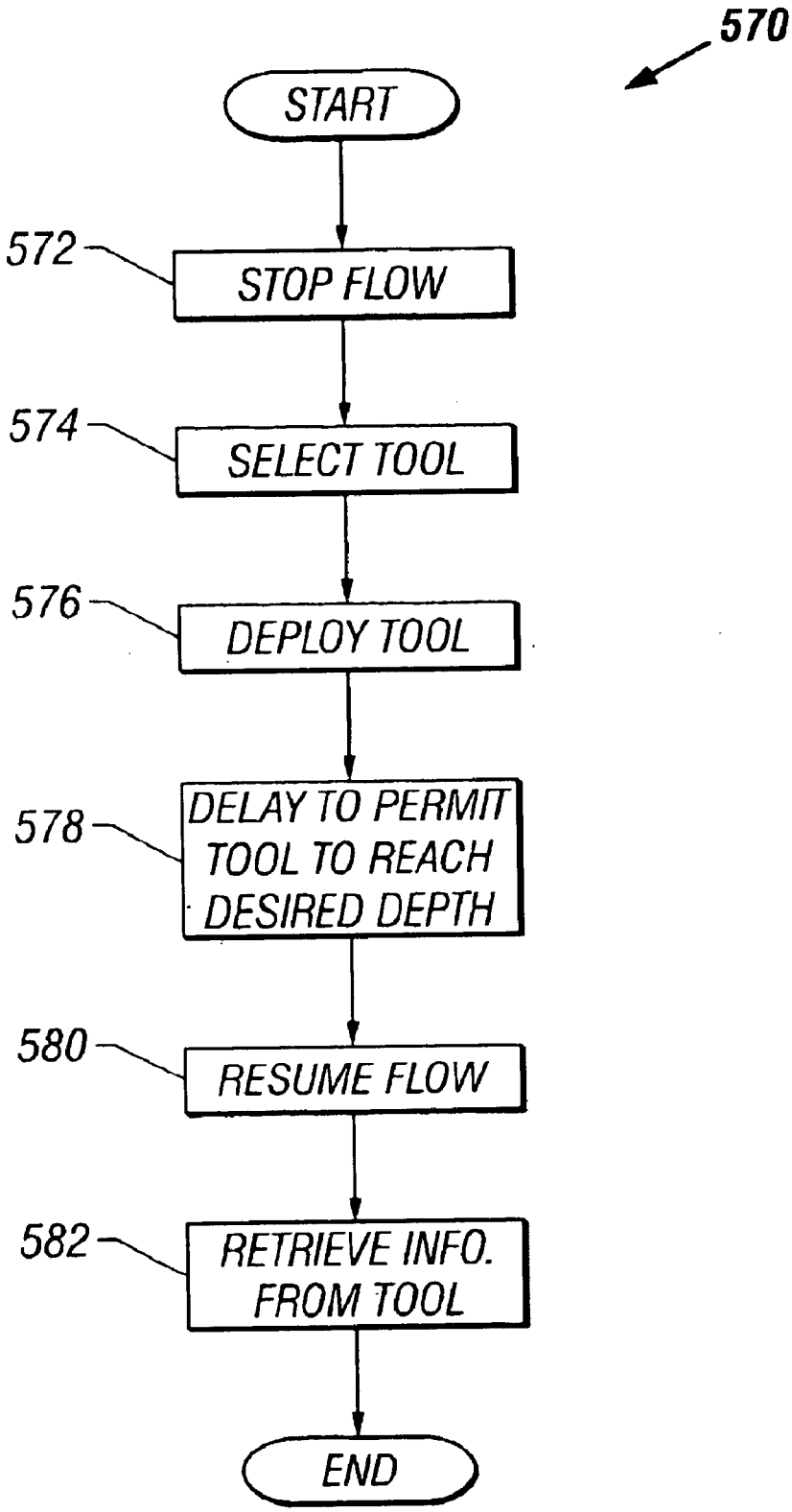
FIG. 19 is a flow diagram depicting a technique to deploy and use a tool from within the well according to an embodiment of the invention.

Referring to FIG. 19, in some embodiments of the invention, a technique 570 may be used in conjunction with the carousel assembly 563 to perform an intervention downhole. In the technique 570, the well head assembly 506 is controlled to stop (block 572) the flow of well fluid. Next, the appropriate tool 565 is selected (block 574) from the carousel assembly 563. For example, this may include activating the motor 562 to rotate the carousel assembly 563 to place the appropriate tool 65 in line with the tubing 566. Thus, when this alignment occurs, the tool 565 is deployed (block 576) downhole.

Figure 20:
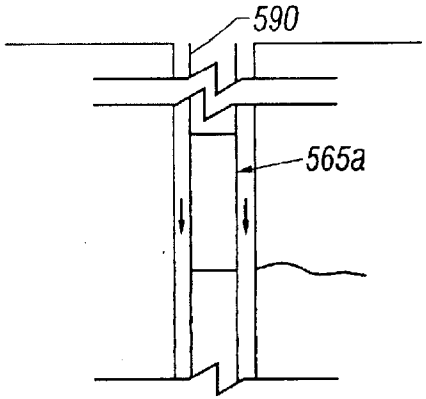
Figure 21:
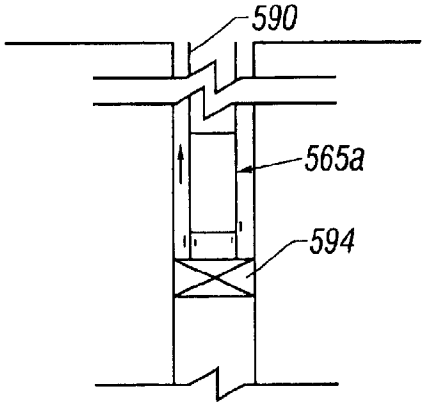

Referring also to FIGS. 20 and 21, as an example, a tool 565*a* to set a plug 594 downhole may be selected. Thus, as depicted in FIG. 20, once deployed, the tool 565*a* descends down a production tubing 590 of the well until the tool 565*a* reaches a predetermined depth, a depth that is programmed into the tool 565*a* prior to its release. When the tool 565*a* reaches the predetermined depth, the tool 565*a* sets the plug 594, as depicted in FIG. 21.

After the expiration of a predetermined delay (block 578), the wellhead assembly 506 is controlled to resume the flow of well fluids through the production tubing 590, as depicted in block 580 of FIG. 19. As shown in FIG. 21, the flow of the fluids pushes the tool 565*a* back uphole. The tool 565*a* then enters the appropriate tubing 564 of the carousel assembly 563, and then the carousel assembly 563 rotates to place the tool 565*a* in the appropriate position so that information may be retrieved (block 582 of FIG. 19) from the tool 565*a*, such as information that indicates whether the tool 565 successfully set the plug 594, for example.

Figure 22:
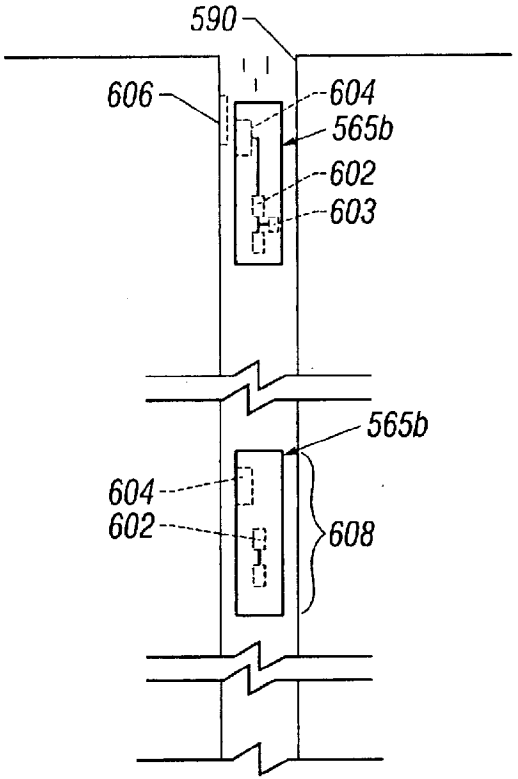
FIGS. 20, 21, 22 and 23 are schematic diagrams depicting deployment and retrieval of tools according to different embodiments of the invention.

Besides indicating whether a run was successful, the tool 565 may be dropped downhole to test conditions downhole and provide information about these conditions when the tool returns to the carousel assembly 563. For example, FIG. 22 depicts a tool 565*b* that may be deployed downhole to measure downhole conditions at one or more predetermined depths, such as a composition of well fluid, a pressure and a temperature. The tool 565*b* includes a pressure sensor to 603 to measure the pressure that is exerted by well fluid as the tool 565*b* descends downhole. In this manner, from the pressure reading, electronics 602 (a microcontroller, an analog-to-digital converter (ADC) and a memory, for example) of the tool 565*b* determines the depth of the tool 565*b*. At a predetermined depth, the electronics 602 obtains a measurement from one or more sensors 603 (one sensor 603 being depicted in FIG. 22) of the tool 565*b*. As examples, the sensor 603 may sense the composition of the well fluids or sense a temperature. The results of this measurement are stored in a memory of the electronics 602. Additional measurements may be taken and stored at other predetermined depths. Thus, when the tool 565*b* is at a position 608*a*, the tool 565*b* takes one or more measurements and may take other measurements at other depths.

Eventually, flow is reestablished (via interaction with the wellhead assembly 506) to reestablish a flow to cause the tool 565*b* to flow uphole until reaching the position indicated by reference numeral 608 in FIG. 22. As the tool 565*b* travels past the position 608*b*, a transmitter 604 of the tool 565*b* passes a receiver 606 that is located on the production tubing 590. When the transmitter 604 approaches into close proximity of the receiver 606, the transmitter 604 communicates indications of the measured data to the receiver 606. As an example, the receiver 606 may be coupled to electronics to communicate the measurements to the host platform 502. Based on these measurements, further action may be taken, such as subsequently running a plug setting tool downhole to block off a particular zone, as just a few examples.

Figure 23:
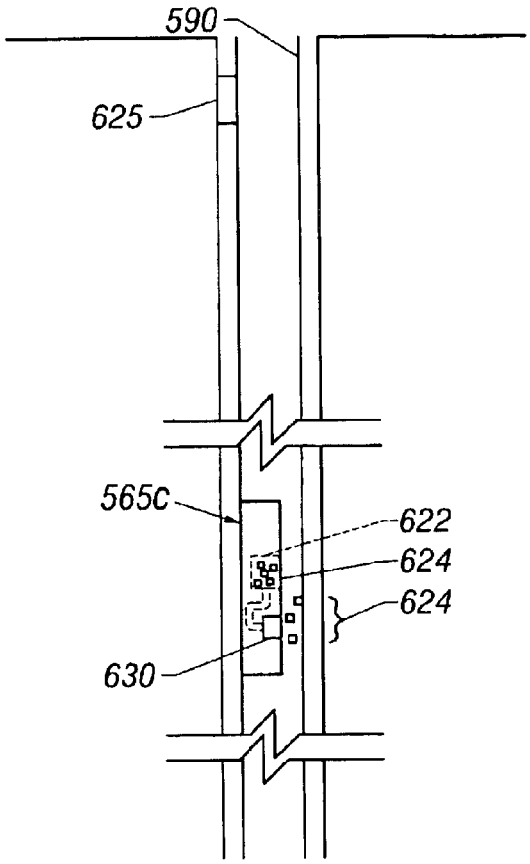

FIG. 23 depicts a tool 565*c* that represents another possible variation in that the tool 565*c* releases microchip sensors 624 to flow uphole to log temperatures and/or fluid compositions at several depths. In this manner, the tool 565*c* may travel downhole until the tool 565*c* reaches a particular depth. At this point, the tool 565*c* opens a valve 630 to release the sensors 624 into the passageway of the tubing 590. The sensors 624 may be stored in a cavity 622 of the tool 565*c* and released into the tubing 590 via the valve 630.

In some embodiments of the invention, the chamber 622 is pressurized at atmospheric pressure. In this manner, as each sensor 624 is released, the sensor 624 detects the change in pressure between the atmospheric pressure of the chamber 622 and the pressure at the tool 565*c* where the sensor 624 is released. This detected pressure change activates the sensor 624, and the sensor 624 may then measure some property immediately or thereafter when the sensor 624 reaches a predetermined depth. As the sensors 624 rise upwardly to reach the wellhead, the sensors 624 pass a receiver 625. In this manner, transmitters of the sensors 624 communicate the measured properties to the receiver 625 as the sensors 624 pass by the receiver 625. Electronics may then be used to take the appropriate actions based on the measurements. Alternatively, the sensors 624 may flow through the communication lines to the host platform 502 where the sensors 624 may be collected and inserted into equipment to read the measurements that are taken by the sensors.

Figure 24:
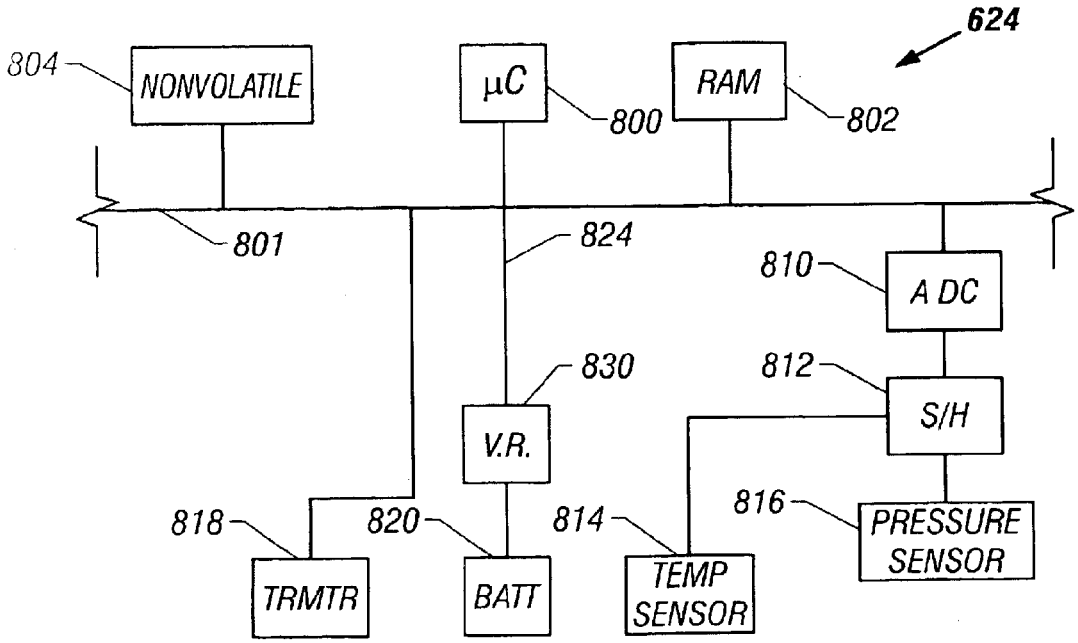
FIG. 24 is an electrical schematic diagram of a free flowing sensor according to an embodiment of the invention.

FIG. 24 depicts one of many possible embodiments of the sensor 624. The sensor 624 may include a microcontroller 800 that is coupled to a bus 801, along with a random access memory (RAM) 802 and a nonvolatile memory (a read only memory) 804. As an example, the RAM 802 may store data that indicates the measured properties, and the nonvolatile memory 804 may store a copy of a program that the microcontroller 800 executes to cause the sensor 624 to perform the functions that are described herein. The RAM 802, nonvolatile memory 804 and microcontroller 800 may be fabricated on the same semiconductor die, in some embodiments of the invention.

The sensor 624 also may also include a pressure sensor 816 and a temperature sensor 814, both of which are coupled to sample and hold (S/H) circuitry 812 that, in turn, is coupled to an analog-to-digital converter (ADC) 810 that is coupled to the bus 801. The sensor 624 may also include a transmitter 818 that is coupled to the bus 801 to transmit indications of the measured data to a receiver. Furthermore, the sensor 624 may include a battery 820 that is coupled to a voltage regulator 830 that is coupled to voltage supply lines 824 to provide power to the components of the sensor 624.

In some embodiments of the invention, the components of the sensor 624 may be surface mount components that are mounted to a printed circuit board. The populated circuit board may be encapsulated via an encapsulant (an epoxy encapsulant, for example) that has properties to withstand the pressures and temperatures that are encountered downhole. In some embodiments of the invention, the pressure sensor 816 is not covered with a sufficiently resilient encapsulant to permit the sensor 816 to sense the pressure. In some embodiments of the invention, the sensor 816 may reside on the outside surface of the encapsulant for the other components of the sensor 624. Other variations are possible.

While the invention has been disclosed with respect to a limited number of embodiments, those skilled in the art, having the benefit of this disclosure, will appreciate numerous modifications and variations therefrom. It is intended that the appended claims cover all such modifications and variations as fall within the true spirit and scope of the invention.

What is claimed is:

1. A system usable with subsea wells that extend beneath a sea floor, the system comprising:

an underwater vehicle; and a station located on the sea floor, the station comprising a docking station adapted to dock to the vehicle and furnish power to the vehicle when docked to the vehicle, wherein the underwater vehicle is housed in the station when no tasks are to be performed by the underwater vehicle.

2. The system of claim 1, wherein the underwater vehicle is adapted to move to one of the subsea wells to service said one of the subsea wells without a tethered cable connection.

3. The system of claim 1, further comprising:

a cable connected to furnish power to the docking station, the cable receiving power from equipment at the surface of the sea.

4. The system of claim 1, wherein the docking station is adapted to dock to the vehicle to establish communication between the vehicle and an operator.

5. The system of claim 1, wherein the vehicle comprises a battery to power the vehicle when the vehicle moves between the docking station and the well.

6. The system of claim 1, wherein the vehicle comprises a sensor to detect a location of the well.

7. The system of claim 6, wherein the sensor comprises a light sensor.

8. The system of claim 6, wherein the sensor comprises a sonar transducer.

9. The system of claim 1, further comprising:

another docking station located near the well, said docking station adapted to dock to the vehicle and provide communication to control the vehicle when the vehicle is docked to said another docking station.

10. The system of claim 9, wherein said another docking station comprises:

an emitter to furnish a signal to guide the vehicle to said another station.

11. The system of claim 10, wherein the emitter comprises a laser.

12. The system of claim 10, wherein the emitter comprises an acoustic transmitter.

13. The system of claim 9, wherein the vehicle is adapted to form a tethered connection to said another docking station when docked to said another docking station.

14. The system of claim 9, wherein the station is adapted to provide power to the vehicle when the vehicle is docked to said another station.

15. The system of claim 1, further comprising:

at least one track extending between at least one of the wells and the station.

16. The system of claim 1, further comprising:

another docking station located near a region designated to receive parts dropped from the surface of the sea, said another docking station adapted to dock to the vehicle and provide communication to control the vehicle when the vehicle is docked to said another docking station.

17. The system of claim 1, further comprising:

another docking station located near a region designated to receive parts dropped from the surface of the sea, said another docking station adapted to dock to the vehicle and provide power to the vehicle when the vehicle is docked to said another docking station.

18. The system of claim 1, further comprising:

at least one additional remotely operated vehicle housed in the station.

19. The system of claim 1, further comprising:

at least one package housed in the station to control a subsea well during an intervention, the package comprising equipment to control a well.

20. The system of claim 1, further comprising:

at least one tool carousel module housed in the station and containing tools to be used in an intervention.

21. The system of claim 20, further comprising at least one of the following:

a wireline-based delivery system;

a slickline-based delivery system; and a coiled tubing-based delivery system.

22. A method usable with subsea wells that extend beneath a sea floor, comprising:

positioning a station on the sea floor;

using the station to power an underwater vehicle;

using the station to communicate with the underwater vehicle;

using the station to dock to the underwater vehicle and provided power to the underwater vehicle when docked to the underwater vehicle;

using the vehicle to service at least one of the subsea wells; and housing the underwater vehicle in the station when no tasks are to be performed by the underwater vehicle.

23. The method of claim 22, further comprising:

moving the vehicle from the station to said one of the subsea wells to service said one of the subsea wells; and not communicating with the vehicle during at least most of the movement of the vehicle from the station to said one of the subsea wells.

24. The method of claim 23, wherein the act of not communicating comprises:

not using a tethered connection to communicate with the vehicle during at least most of the movement of the vehicle from the station to said one of the subsea wells.

25. The method of claim 23, further comprising:

before the moving, undocking the vehicle from a docking station near the station; and after the moving, docking the vehicle to another docking station near said one of the subsea wells.

26. The method of claim 23, further comprising:

supplying power from a surface of the sea to the vehicle before and after the movement of the vehicle; and using a battery to provide power to the vehicle during the movement.

27. The method of claim 23, further comprising:

during the movement of the vehicle, navigating the vehicle without remotely operating the vehicle.

28. The method of claim 22, further comprising:

moving the vehicle from the station to a region designated to receive parts dropped from the surface of the sea; and operating the vehicle to gather the dropped parts.

29. The method of claim 22, further comprising:

operating the vehicle to attach an untethered buoyant assembly to a part to send the part to the surface of the sea.

30. The method of claim 22, further comprising:

in the station, storing a part for use in the servicing of said at least one of the subsea wells.

31. The method of claim 22, further comprising:

storing parts in the station; and selectively securing the parts to the vehicle for use in servicing said one of the subsea wells.

32. The method of claim 22, further comprising:

using the vehicle to assemble equipment together to form an assembly to perform the service; and using the vehicle to move the assembly to a subsea wellhead assembly and attach the assembly to the wellhead assembly.

33. The method of claim 32, wherein at least some of the equipment is housed in the station.

34. The method of claim 22, further comprising:

using the station to power and communicate with at least one additional remotely operated vehicle.

35. The method of claim 22, further comprising:

storing at least one well control package in the station to control a subsea well head assembly.

36. The method of claim 22, further comprising:

storing at least one tool carousel module in the station, each of said at least one carousel module containing well tools.

37. The method of claim 22, further comprising:

storing at least one delivery system module in the station.

38. The system of claim 37, wherein the delivery system comprises at least one of the following:

a wireline-based delivery system;

a slickline-based delivery system; and a coiled tubing-based delivery system.

39. An apparatus comprising:

a docking station adapted to a reside on a sea floor, dock to an underwater vehicle and furnish power to the vehicle when docked to the vehicle, wherein the underwater vehicle is adapted to service at least one of multiple subsea wells and the underwater vehicle is housed in the station when no tasks are to be performed by the underwater vehicle.

40. The apparatus of claim 39, further comprising:

a cable connected to furnish power to the docking station, the cable receiving power from equipment at the surface of the sea.

41. The apparatus of claim 39, wherein the docking station is adapted to dock to the vehicle to establish communication between the vehicle and an operator.

42. The apparatus of claim 39, further comprising:

at least one track extending between at least one of the wells and the station.

43. The apparatus of claim 39, further comprising:

at least one delivery system module housed in the station.

44. The apparatus of claim 43, wherein the delivery system comprises at least one of the following:

a wireline-based delivery system;

a slickline-based delivery system; and a coiled tube-based delivery system.

* * * * *